US010638544B2

(12) United States Patent
Ooyama et al.

(10) Patent No.: US 10,638,544 B2
(45) Date of Patent: Apr. 28, 2020

(54) HEATING METHOD, HEATING APPARATUS AND METHOD OF MANUFACTURING PRESS-MOLDED ARTICLE

(71) Applicant: NETUREN CO., LTD., Tokyo (JP)

(72) Inventors: Hironori Ooyama, Tokyo (JP); Fumiaki Ikuta, Yokyo (JP)

(73) Assignee: NETUREN CO., LTD., Tokyo (JP)

( * ) Notice: Subject to any disclaimer, the term of this patent is extended or adjusted under 35 U.S.C. 154(b) by 65 days.

(21) Appl. No.: 15/320,502

(22) PCT Filed: Jun. 22, 2015

(86) PCT No.: PCT/JP2015/068593
§ 371 (c)(1),
(2) Date: Dec. 20, 2016

(87) PCT Pub. No.: WO2015/199239
PCT Pub. Date: Dec. 30, 2015

(65) Prior Publication Data

US 2017/0164425 A1 Jun. 8, 2017

(30) Foreign Application Priority Data

Jun. 24, 2014 (JP) ..... 2014-129463

(51) Int. Cl.
*H05B 3/00* (2006.01)
*C21D 9/00* (2006.01)
(Continued)

(52) U.S. Cl.
CPC ..... *H05B 3/0004* (2013.01); *B21D 22/022* (2013.01); *B21D 22/208* (2013.01);
(Continued)

(58) Field of Classification Search
CPC ..... H05B 3/0004; H05B 3/023; H05B 3/03; C21D 1/40; C21D 1/673; C21D 9/0068; B23K 11/061
(Continued)

(56) References Cited

U.S. PATENT DOCUMENTS 4,425,496 A * 1/1984 le Fur ..... H01G 13/06 204/164
5,042,281 A * 8/1991 Metcalfe ..... B21B 9/00 219/81
(Continued)

FOREIGN PATENT DOCUMENTS

JP 61-37922 2/1986
JP 02111817 A * 4/1990
(Continued)

OTHER PUBLICATIONS

International Search Report dated Sep. 24, 2015 in International Application No. PCT/JP2015/068593.
(Continued)

*Primary Examiner* — Alex M Valvis
(74) *Attorney, Agent, or Firm* — Wenderoth, Lind & Ponack, L.L.P.

(57) ABSTRACT

A heating method, a heating apparatus, and a method of manufacturing a press-molded article using the heating method are provided. A pair of electrodes is arranged on a workpiece along a first direction. Each electrode has a length extending across a first heating area of the workpiece in the first direction. At least one of the electrodes is moved in the first heating area and along a second direction intersecting the first direction at a constant speed while applying electric current between the pair of electrodes to heat the first heating area by direct resistance heating. The electric current applied between the pair of electrodes is adjusted such that a heating temperature is adjusted for each segment into which the first
(Continued)

heating area is divided so as to be side by side in the second direction.

5 Claims, 19 Drawing Sheets

(51) Int. Cl.

| | |
|---|---|
| ***H05B 3/03*** | (2006.01) |
| ***H05B 3/02*** | (2006.01) |
| ***H05B 3/06*** | (2006.01) |
| ***H05B 3/42*** | (2006.01) |
| ***B21D 22/02*** | (2006.01) |
| ***C21D 1/40*** | (2006.01) |
| ***B21D 22/20*** | (2006.01) |
| *C21D 1/673* | (2006.01) |

(52) U.S. Cl.
CPC ..... *C21D 1/40* (2013.01); *C21D 9/0012* (2013.01); *H05B 3/023* (2013.01); *H05B 3/03* (2013.01); *H05B 3/06* (2013.01); *H05B 3/42* (2013.01); *C21D 1/673* (2013.01); *C21D 2221/00* (2013.01); *C21D 2221/10* (2013.01)

(58) Field of Classification Search
USPC ..... 219/50
See application file for complete search history.

(56) References Cited

U.S. PATENT DOCUMENTS

| | | | | |
|---|---|---|---|---|
| 5,676,862 | A * | 10/1997 | Matteson | B23K 11/063 219/110 |
| 2003/0217991 | A1* | 11/2003 | Gomez | C21D 1/40 219/50 |
| 2010/0269559 | A1* | 10/2010 | Ishiguro | H05B 3/0004 72/342.1 |
| 2010/0285328 | A1* | 11/2010 | Nonomura | B21D 22/02 428/600 |
| 2014/0339210 | A1 | 11/2014 | Kobayashi et al. | |
| 2015/0173125 | A1* | 6/2015 | Ooyama | C21D 9/0068 219/162 |
| 2015/0208466 | A1 | 7/2015 | Ooyama et al. | |

FOREIGN PATENT DOCUMENTS

| | | |
|---|---|---|
| JP | 3587501 | 11/2004 |
| JP | 2007-224319 | 9/2007 |
| JP | 2013-114942 | 6/2013 |
| JP | 2013-240817 | 12/2013 |
| JP | 2014-15658 | 1/2014 |
| JP | 2014-173148 | 9/2014 |
| WO | 2013/081180 | 6/2013 |
| WO | 2014/025054 | 2/2014 |

OTHER PUBLICATIONS

Written Opinion of the International Searching Authority dated Sep. 24, 2015 in International Application No. PCT/JP2015/068593.

* cited by examiner

HEATING METHOD, HEATING APPARATUS AND METHOD OF MANUFACTURING PRESS-MOLDED ARTICLE

CROSS-REFERENCE TO RELATED APPLICATION

This application is based on Japanese Patent Application No. 2014-129463 filed on Jun. 24, 2014, the entire content of which is incorporated herein by reference.

TECHNICAL FIELD

The present invention relates to a heating method, a heating apparatus, and a method of manufacturing a press-molded article, in which a workpiece is heated by direct resistance heating.

BACKGROUND ART

Methods of heating a steel workpiece include indirect heating and direct heating. An example of the indirect heating is furnace heating. Examples of the direct heating include induction heating in which eddy current is applied to a workpiece to heat the workpiece and direct resistance heating in which electric current is directly applied to a workpiece to heat the workpiece.

JP 3587501 B2 discloses a method of heating a plate workpiece by direct resistance heating, the workpiece having a heating area with a varying cross-section in which the thickness or the width varies in the longitudinal direction. The heating area of a workpiece is sectioned into a plurality of strip-shaped segments along the longitudinal direction of the workpiece, a pair of electrodes is provided for each segment, and electric current is supplied to each pair of electrodes.

JP 2013-114942 A discloses a method of heating a plate workpiece by direct resistance heating, the workpiece having a heating area with a varying cross-section. For example, in the heating area of a workpiece in which the width monotonically decreases from one end to the other end in the longitudinal direction, a pair of electrodes is disposed at one end having a relatively large width, one electrode moves along the longitudinal direction while supplying a constant current between the pair of electrodes, and the moving speed of the electrode is adjusted base on the variation in the width of the workpiece. In the heating method disclosed in JP 3587501 B2, since multiple pairs of electrodes are required for a single heating area and the electric current is adjusted for each pair of electrodes, the configuration of the heating apparatus is complicated. On the other hand, in the heating method disclosed in JP 2013-114942 A, since a heating area can be heated with a single pair of electrodes, it is possible to simplify the configuration of the heating apparatus.

However, in the heating method disclosed in JP 2013-114942 A, the electric current flowing between the pair of electrodes is kept constant and the moving speed of the electrode is adjusted based on the variation in the width of the workpiece. In order to heat the heating area of the workpiece, for example, at a uniform temperature using this heating method, it is necessary to enhance responsiveness of the moving electrode to speed control. However, since the moving of the electrode is accompanied by moving of a support member of the electrode, a relatively heavy object is moved. Accordingly, in order to ensure the responsiveness of the moving electrode to speed control, an output corresponding to a drive source is required and relatively advanced control is necessary.

SUMMARY OF INVENTION

It is an object of the present invention to provide a heating method and a heating apparatus which can easily heat a plate workpiece to be in a desired temperature distribution.

According to an aspect of the present invention, a heating method includes arranging a pair of electrodes on a workpiece along a first direction, the pair of electrodes having a length extending across a first heating area of a workpiece in the first direction, moving at least one of the electrodes in the first heating area and along a second direction intersecting the first direction at a constant speed while applying electric current between the pair of electrodes to heat the first heating area by direct resistance heating, and adjusting the electric current applied between the pair of electrodes such that a heating temperature is adjusted for each segment into which the first heating area is divided so as to be side by side in the second direction.

According to another aspect of the present invention, a heating apparatus includes a pair of electrodes arranged to extend across a first heating area of a workpiece in a first direction, a current supply unit configured to supply electric current to the pair of electrodes, a moving mechanism configured to move at least one of the electrodes in the first heating area and along a second direction intersecting the first direction at a constant speed, and a control unit configured to adjust the electric current applied between the pair of electrodes such that a heating temperature is adjusted for each segment into which the first heating area is divided so as to be side by side in the second direction.

According to another aspect of the present invention, a method of manufacturing a press-molded article is provided. The method includes heating a plate workpiece using the heating method described above, and performing a hot press molding process by pressing the plate workpiece using a press mold.

BRIEF DESCRIPTION OF THE DRAWINGS

FIGS. 16A to 161 are diagrams illustrating still another modified example of the plate workpiece and the heating apparatus and the heating method illustrated in FIGS. 13A to 13D.

DESCRIPTION OF EMBODIMENTS

Figure 1A:
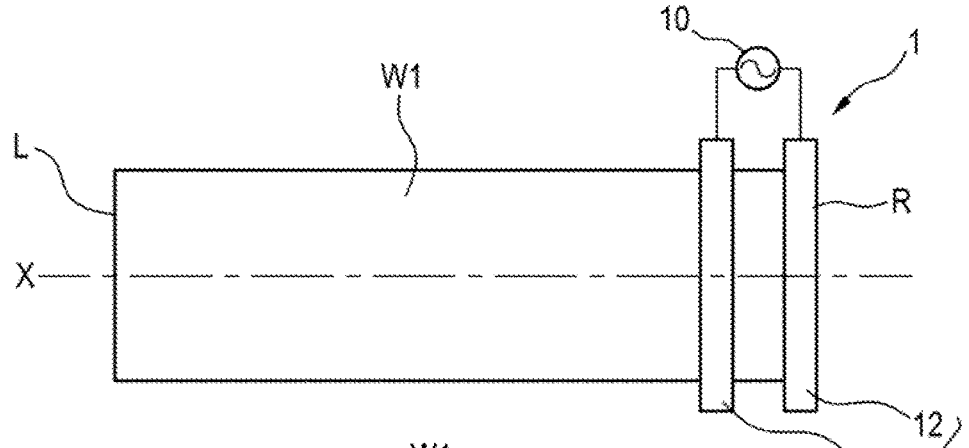
FIGS. 1A to 1E are diagrams illustrating a configuration of an example of a plate workpiece and a heating apparatus and a heating method according to an embodiment of the invention.
Figure 1B:
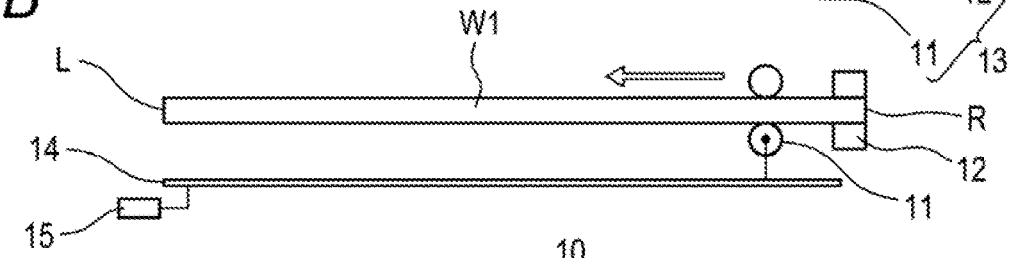
Figure 1C:
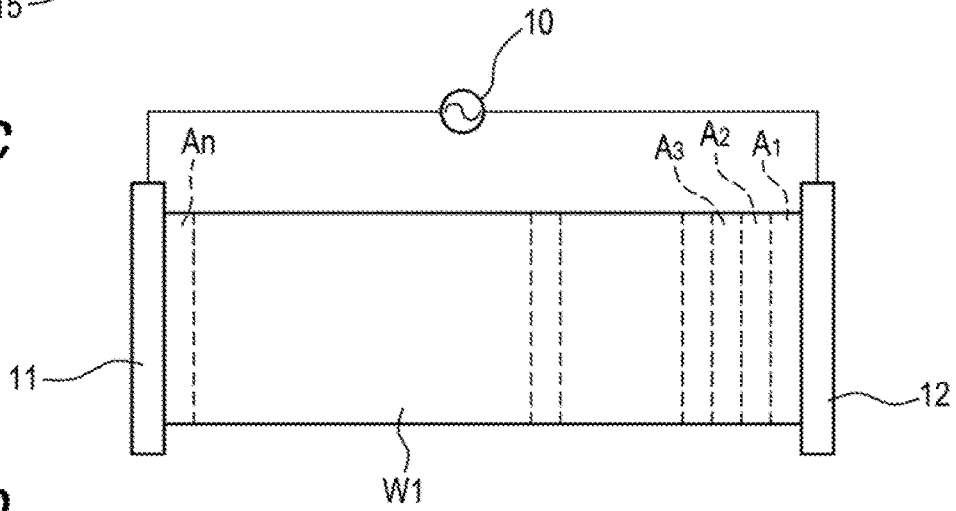
Figure 1D:
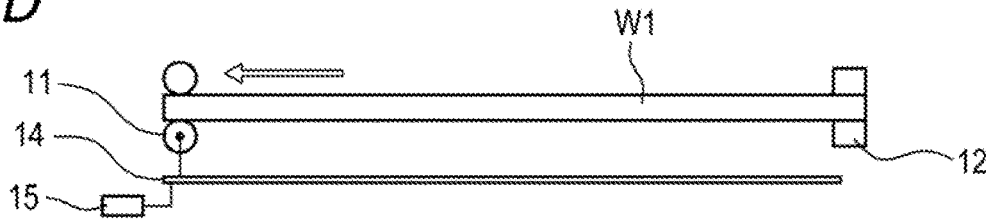

Hereinafter, embodiments of the present invention will be described with reference to the drawings.

FIGS. 1A to 1E are diagrams schematically illustrating a configuration of an example of a plate workpiece and a heating apparatus and a heating method according to an embodiment of the invention.

A workpiece W1 illustrated in FIGS. 1A to 1D serves as a single heating area as a whole. The workpiece W1 has a constant thickness and a constant width. In the example illustrated in the drawing, the workpiece W1 has a rectangular shape which is symmetric with respect to an axis X passing through the center of one end L and extending along the longitudinal direction of the workpiece W1.

A heating apparatus 1 for heating the workpiece W1 includes a current supply unit 10, a pair of electrodes 13 including electrodes 11, 12, a moving mechanism 14, and a control unit 15.

The current supply unit 10 supplies electric current to the pair of electrodes 13. The current supplied from the current supply unit 10 to the pair of electrodes 13 is adjusted in accordance with speed controlled by the control unit 15.

The electrodes 11, 12 of the pair of electrodes 13 are arranged along the width direction of the workpiece W1 (heating area), each of the electrodes 11, 12 having a length extending across the workpiece W1 in the width direction. In the example illustrated in FIGS. 1A to 1D, the electrode 12 is disposed at one end R of the workpiece W1 and is fixed at the position, and the electrode 11 is supported by the moving mechanism 14 so as to be movable along the longitudinal direction of the workpiece W1 while maintaining contact with the workpiece W1. Hereinafter, the electrode 11 is referred to as a movable electrode and the electrode 12 is referred to as a fixed electrode.

The moving mechanism 14 moves the movable electrode 11 at a constant speed along the longitudinal direction of the workpiece W1 under the control of the control unit 15.

When heating the workpiece W1, in the example illustrated in FIGS. 1A to 1E, the movable electrode 11 is placed at the end R of the workpiece W1 at which the fixed electrode 12 is disposed. Then, the movable electrode 11 is moved at a constant speed from the end R of the workpiece W1 to the end L in a state in which electric current is applied between the pair of electrodes 13.

The gap between the movable electrode 11 and the fixed electrode 12 is gradually expanded along with the movement of the movable electrode 11. The electric current flows through a section of the workpiece W1 between the movable electrode 11 and the fixed electrode 12 to heat the section.

While moving the movable electrode 11 at a constant speed, the electric current applied between the pair of electrodes 13 is adjusted such that the heating temperature is adjusted for each segment (A1, A2, . . . , An) into which the workpiece W1 (heating area) is virtually divided so as to be side by side in the moving direction of the movable electrode 11.

Figure 1E:
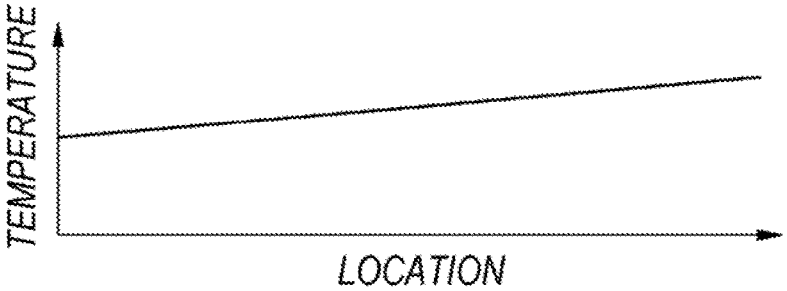

In the workpiece W1 having a constant cross-sectional area in the moving direction of the movable electrode 11, basically, as illustrated in FIG. 1E, a temperature distribution is obtained in which a degree of temperature rise gradually decreases from the end R of the workpiece W1 to the end L along the moving direction of the movable electrode 11. By adjusting the electric current applied between the pair of electrodes 13, for example, it is possible to increase or decrease the degree of temperature rise of the workpiece W1 as a whole and to expand or reduce a temperature difference between both ends of the workpiece W1.

FIGS. 2A to 2E illustrate a modified example of the heating method illustrated in FIGS. 1A to 1E.

In the example illustrated in FIGS. 2A to 2E, the moving mechanism 14 is installed in each of the electrodes 11, 12, the movable electrode 11 is moved at a constant speed from the center of the workpiece W1 to the end L along the longitudinal direction of the workpiece W1, and the movable electrode 12 is moved at a constant speed from the center of the workpiece W1 to the end R along the longitudinal direction of the workpiece W1. The moving speeds of the movable electrodes 11, 12 may be equal to each other or may be different from each other.

Figure 2A:
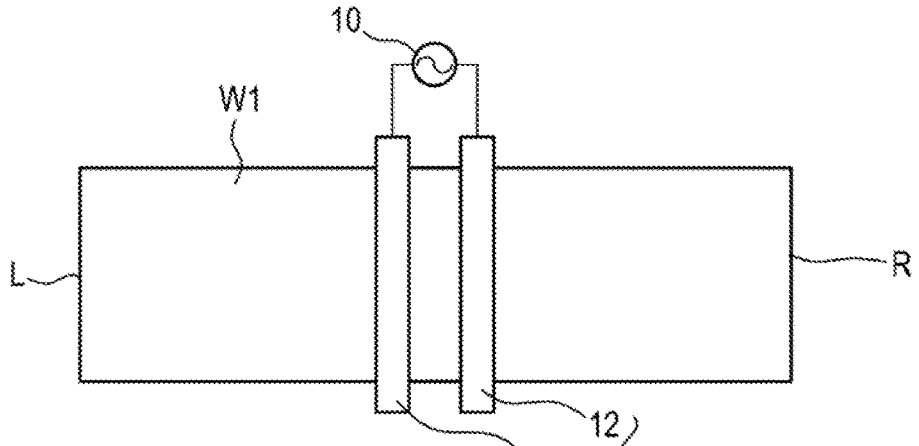
FIGS. 2A to 2E are diagrams illustrating a modified example of the heating method illustrated in FIGS. 1A to 1E.
Figure 2B:
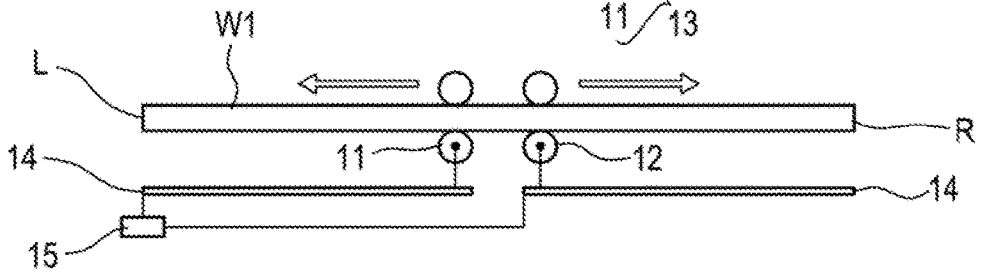
Figure 2C:
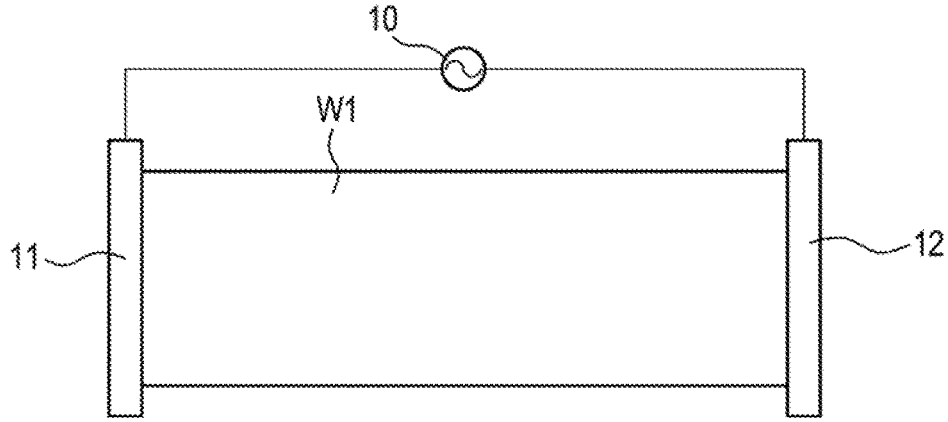
Figure 2D:
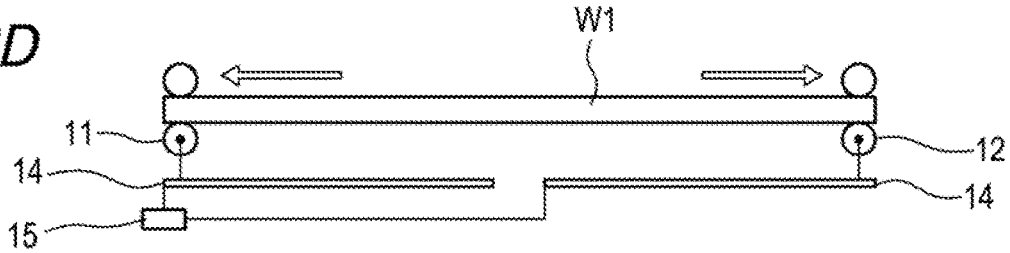
Figure 2E:
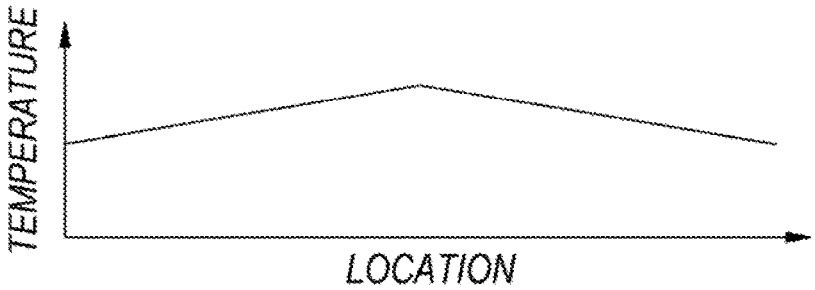

In this example, basically, as illustrated in FIG. 2E, a temperature distribution is obtained in which a degree of temperature rise gradually decreases from the center of the workpiece W1 to both ends L and R. By adjusting the electric current applied between the pair of electrodes 13, for example, it is possible to increase or decrease the degree of temperature rise of the workpiece W1 as a whole and to expand or reduce a temperature difference between both ends L and R of the workpiece W1.

In this way, the pair of electrodes 13 having a length extending across the workpiece W1 (heating area) in the width direction of the workpiece W1 is arranged on the workpiece W1 along the width direction of the workpiece W1, the movable electrode 11 (or the movable electrodes 11, 12) is moved at a constant speed along the longitudinal direction of the workpiece W1 while applying electric current between the pair of electrodes 13, and the electric current applied between the pair of electrodes 13 is adjusted such that the heating temperature is adjusted for each segment into which the workpiece W1 is virtually divided so as to be side by side in the moving direction of the movable electrode 11 (or the movable electrodes 11, 12). Accordingly, it is possible to heat the workpiece W1 in a given temperature distribution using only one pair of electrodes 13 and thus to simplify the configuration of the heating apparatus 1.

In comparison with a case in which the moving speed of the movable electrode 11 (or the movable electrodes 11, 12) is controlled with the electric current between the pair of electrodes 13 kept constant, the control of the current flowing between the pair of electrodes 13 has excellent responsiveness and is easy to control. Accordingly, it is possible to easily heat the workpiece W1 to have a given temperature distribution.

In an example to be described below, a plate workpiece having a thickness or width varying along the longitudinal direction is heated.

FIGS. 3A to 3D are diagrams schematically illustrating a configuration of an example of a plate workpiece and a heating apparatus and a heating method according to an embodiment of the invention.

A workpiece W2 illustrated in FIGS. 3A to 3D serves as a single heating area as a whole. The workpiece W2 has a constant thickness and a width which gradually decreases from one end R in the longitudinal direction to the other end L. In the illustrated example, the workpiece W2 has an isosceles trapezoid shape which is symmetric with respect to an axis X passing through the center of the end L and extending along the longitudinal direction of the workpiece W2. In the workpiece W2 having this shape, resistance per unit length along the longitudinal direction monotonically increases from the end R having a relatively large width to the end L having a relatively small width.

A heating apparatus for heating the workpiece W2 has the same configuration as the heating apparatus 1 illustrated in FIGS. 1A to 1D and includes a current supply unit 10, a pair of electrodes 13 including electrodes 11, 12, a moving mechanism 14, and a control unit 15.

The electrodes 11, 12 of the pair of electrodes 13 are arranged along the width direction of the workpiece W2 (heating area), each of the electrodes 11, 12 having a length extending across the workpiece W2 in the width direction. In the example illustrated in FIGS. 2A to 2D, the electrode 12 is disposed at the end R having a relatively large width in the workpiece W2 and is fixed at the position, and the electrode 11 is supported by the moving mechanism 14 so as to be movable along the longitudinal direction of the workpiece W2 while maintaining contact with the workpiece W2. Hereinafter, the electrode 11 is referred to as a movable electrode and the electrode 12 is referred to as a fixed electrode.

The moving mechanism 14 moves the movable electrode 11 at a constant speed along the longitudinal direction of the workpiece W2 under the control of the control unit 15.

When heating the workpiece W2, in the example illustrated in FIGS. 3A to 3D, the movable electrode 11 is placed at the end R of the workpiece W2 at which the fixed electrode 12 is disposed. Then, the movable electrode 11 is moved at a constant speed from the end R of the workpiece W2 to the end L in a state in which electric current is applied between the pair of electrodes 13.

While moving the movable electrode 11 at a constant speed, the current flowing between the pair of electrodes 13 is adjusted such that the heating temperature is adjusted for each of segment (A1, A2, . . . , An) into which the workpiece W2 (heating area) is virtually divided so as to be side by side in the moving direction of the movable electrode 11.

Particularly, in the workpiece W2 in which the resistance per unit length along the moving direction of the movable electrode 11 monotonically increases in the moving direction of the movable electrode 11, it is possible to heat the workpiece W2 in a predetermined temperature range that can be considered as a substantially uniform temperature.

Figure 4:
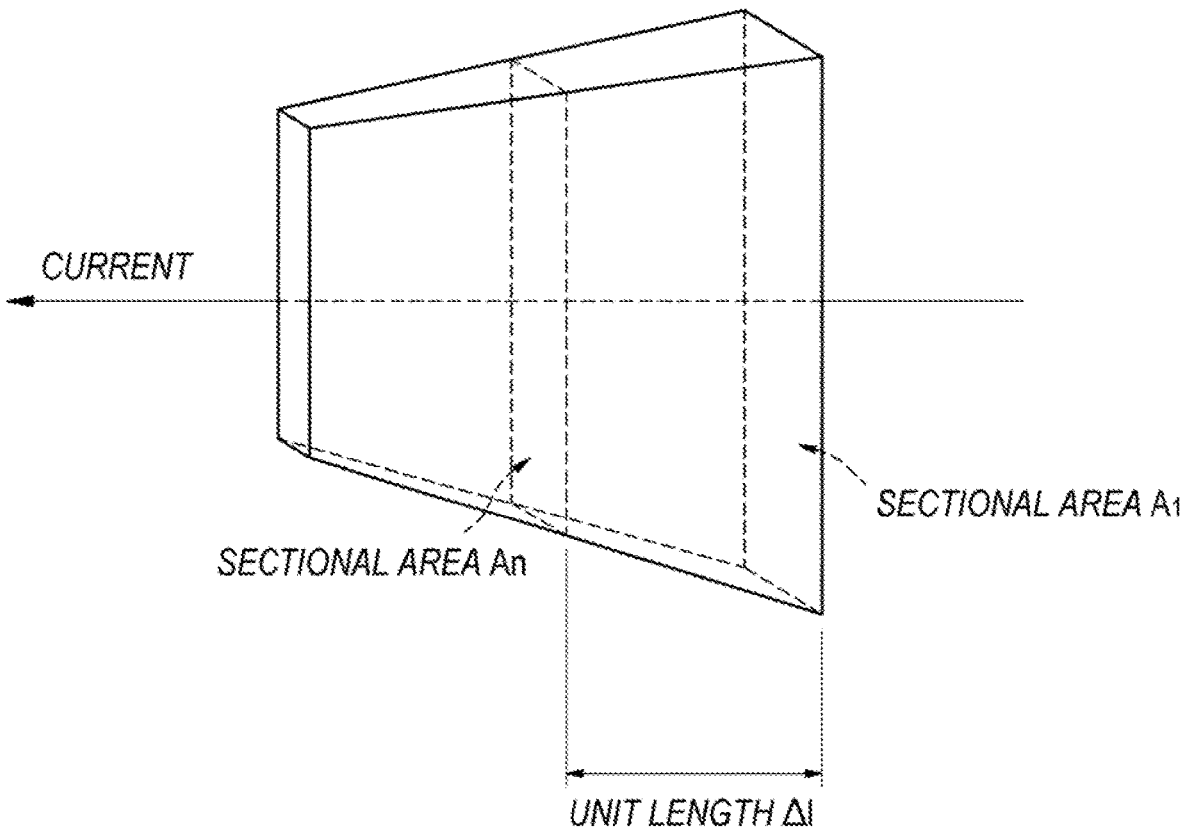
FIG. 4 is a diagram illustrating a concept of current adjustment when a workpiece is heated in a predetermined temperature range using the heating method illustrated in FIGS. 3A to 3D.

FIG. 4 illustrates the concept of current adjustment when the workpiece W2 is heated to be in the predetermined temperature range.

Figure 3A:
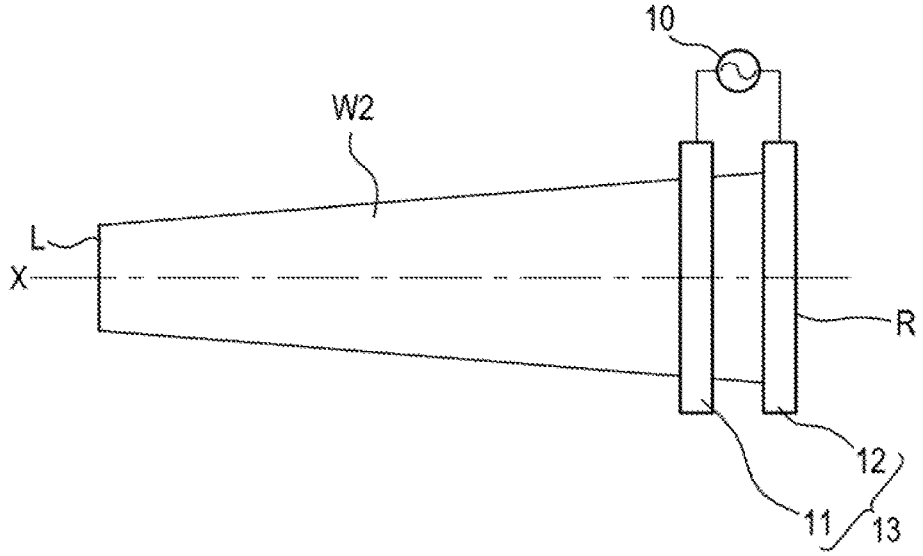
FIGS. 3A to 3D are diagrams illustrating a configuration of another example of a plate workpiece and a heating apparatus and a heating method according to an embodiment of the invention.
Figure 3B:
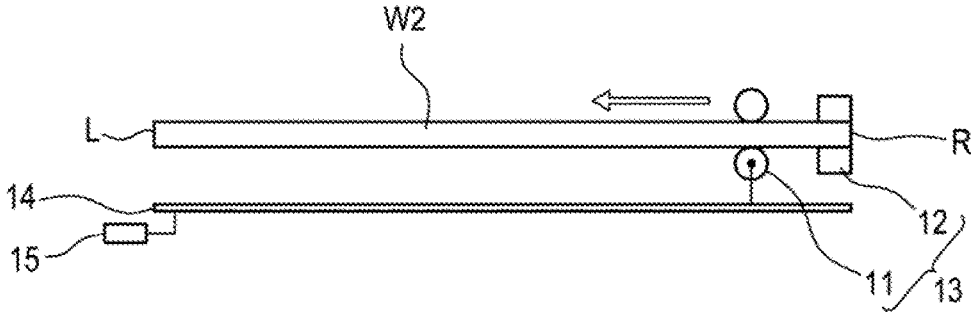
Figure 3C:
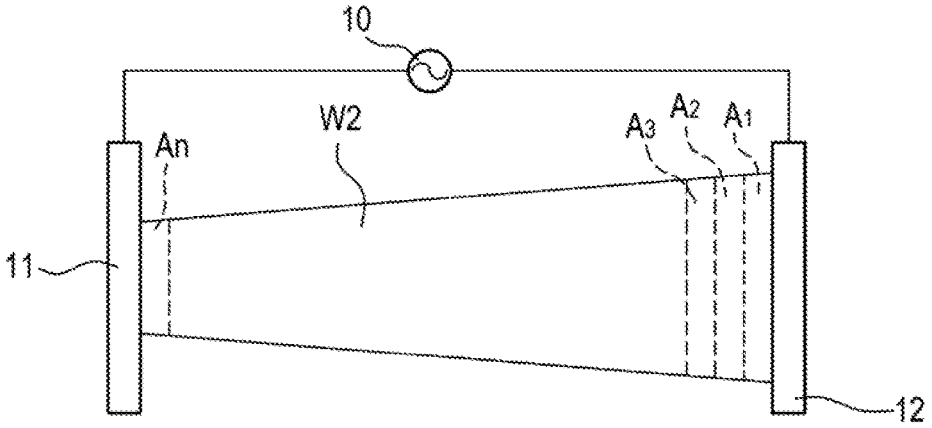
Figure 3D:
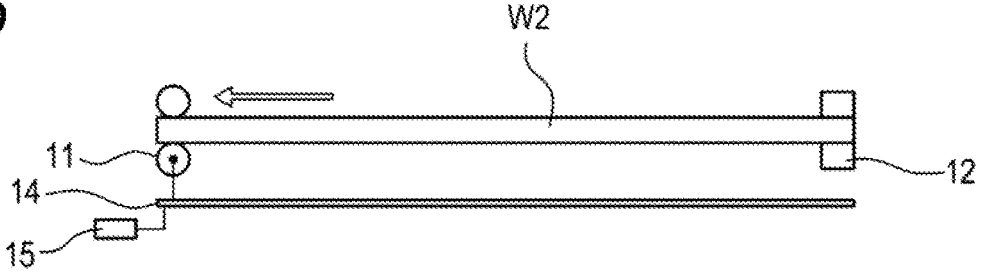

As illustrated in FIG. 3C, the entire length of the workpiece is divided into n virtual segments having a length Δl. When it is assumed that an applied electric current and a current applying time when the movable electrode passes through Δl of the i-th segment are defined as Ii and ti (see), respectively, the temperature rise θi of the i-th segment is expressed by the following equation because the segment is heated after the movable electrode passes through the segment.

$$\theta_i = \frac{\rho_e}{C\rho}\frac{1}{A_i^2}\sum_i^n (I_i^2 \times t_i)$$

Here, ρe denotes resistivity (Ω·m), ρ denotes density (kg/m$^3$), c denotes specific heat (J/kg·° C.), and Ai denotes a cross-sectional area (m$^2$) of the i-th segment.

In order to make the temperatures of the segments constant θ1=θ2= . . . =θn, the applied electric current Ii and the current applying time ti (electrode moving speed Vi=Δl/ti) in the segments may be determined to satisfy the following equation. When the speed is constant, ti is constant and thus only Ii may be determined.

$$\frac{1}{A_1^2}\sum_{i=1}^n (I_i^2 \times t_i) = \frac{1}{A_2^2}\sum_{i=2}^n (I_i^2 \times t_i) = \ldots = \frac{1}{A_n^2}\sum_{i=n}^n (I_i^2 \times t_i)$$

When the fixed electrode 12 is fixed to the end R of the workpiece W2 and the movable electrode 11 moves at a constant speed from the end R of the workpiece W2 to the end L, a current applying section interposed between the movable electrode 11 and the fixed electrode 12 in the workpiece W2 is gradually expanded from the end R side in which the resistance per unit length along the moving direction of the movable electrode 11 is relatively small. Accordingly, the current applying time for each of the segments (A1, A2, . . . , An) are different from each other, and the current applying time of the segment closer to the end R is longer.

When the same current flows in the segment on the end R side and the segment on the end L side for the same time, an amount of heat generated in the segment closer to the end R in which the resistance per unit length along the moving direction of the movable electrode 11 is relatively small (the cross-sectional area is relatively large) is smaller.

Therefore, in the relation with the current applying time for each segment, and based on variations in resistance of the segments obtained from the shape or size of the workpiece W2, that is, based on variations in resistance per unit length of the workpiece W2 along the moving direction of the movable electrode 11, the electric current flowing between the pair of electrodes 13 can be adjusted to substantially equalize the amount of heat generated in each segment and to heat the workpiece W2 to be in a predetermined temperature range that can be considered as a substantially uniform temperature.

Figure 5:
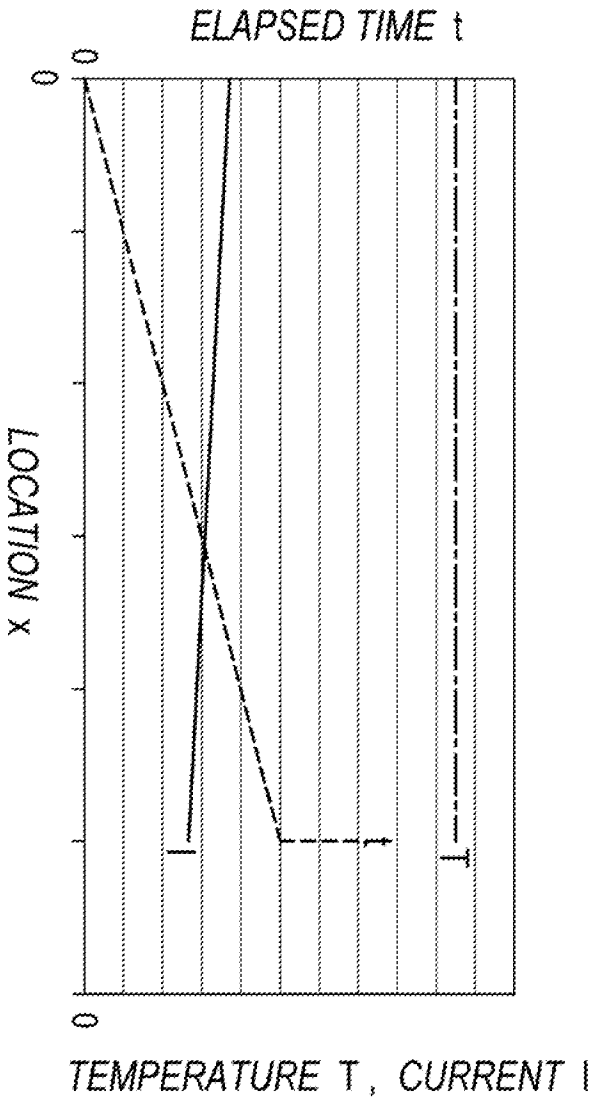
FIG. 5 is a diagram illustrating an example of a relationship between an elapsed time from heating start and a position of a movable electrode, a relationship between movement of the movable electrode and electric current flowing between a pair of electrodes, and a temperature distribution of a workpiece at the time of heating end in the heating method illustrated in FIGS. 3A to 3D.
Figure 6A:
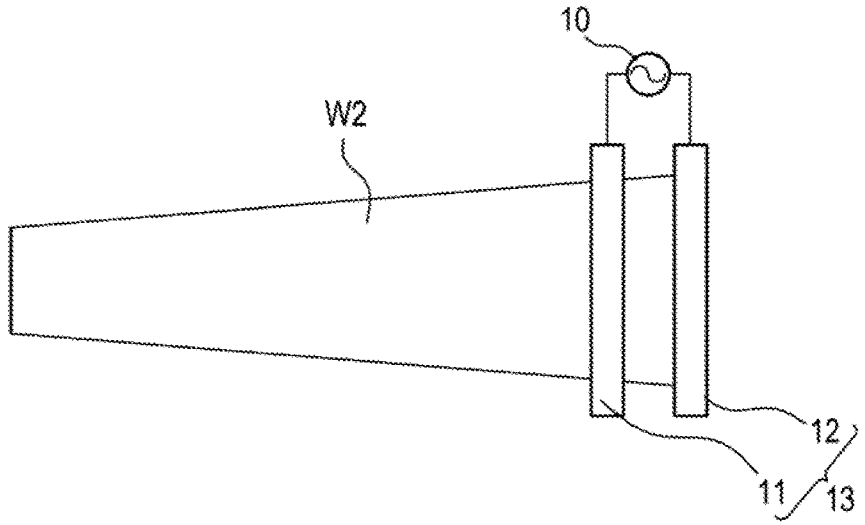
FIGS. 6A to 6D are diagrams illustrating a modified example of the workpiece, the heating apparatus, and the heating method illustrated in FIGS. 3A to 3D.
Figure 6B:
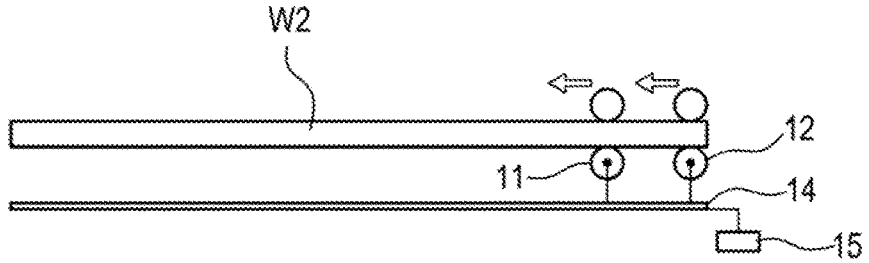
Figure 6C:
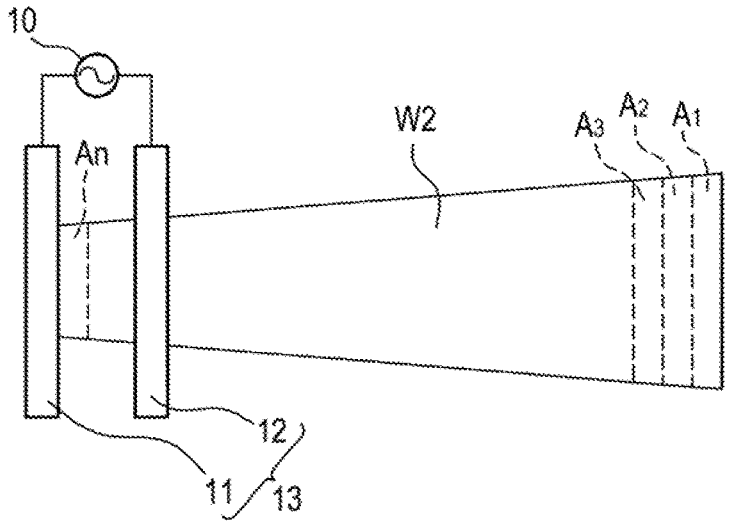
Figure 6D:
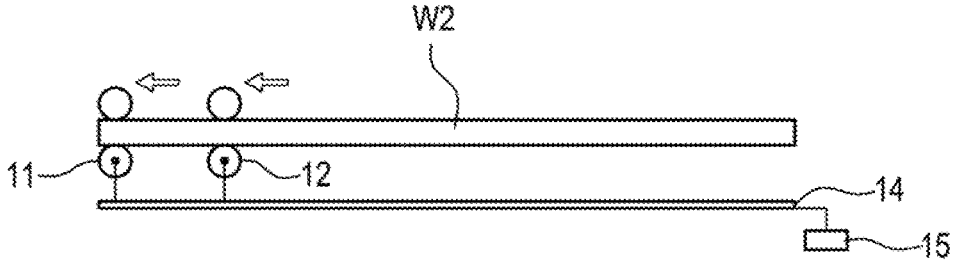

FIG. 5 illustrates an example of a relationship between an elapsed time from heating start and the position of the movable electrode 11, a relationship between the movement of the movable electrode 11 and the electric current flowing between the pair of electrodes 13, and a temperature distribution of the workpiece W2 at the time of heating end in the heating method illustrated in FIGS. 3A to 3D. In FIG. 5, the position of the movable electrode 11 is expressed by a distance from an origin with the initial position (the end R of the workpiece W2) of the movable electrode 11 at the time of heating start as the origin.

In the example illustrated in FIG. 5, while moving the movable electrode 11 at a constant speed from the end R of the workpiece W2 to the end L, the electric current applied between the pair of electrodes 13 is adjusted to gradually decrease. In order to heat the end L of the workpiece W2 to be in a predetermined temperature range, the movable electrode 11 is held at the end L for a predetermined time after the movable electrode 11 reaches the end L, and during that time, the electric current at the time when the movable electrode 11 has reached the end L is applied between the pair of electrodes 13. By this current adjustment, the workpiece W2 is heated to be in the predetermined temperature range that can be considered as a substantially uniform temperature.

FIGS. 6A to 9D illustrate modified examples of the workpiece, the heating apparatus, and the heating method which are illustrated in FIGS. 3A to 3D.

In the example illustrated in FIGS. 6A to 6D, the electrode 11 and the electrode 12 are supported by the moving mechanism 14, and the movable electrodes 11, 12 are moved at a constant speed along the longitudinal direction of the workpiece W2 with a constant gap maintained.

By moving the movable electrodes 11, 12 at a constant speed with a constant gap maintained, the current applying time for each segment (A1, A2, . . . , An) are substantially equal to each other. However, this heating method is the same as the heating method illustrated in FIGS. 3A to 3D, in that the amount of heat generated in the segment closer to the end R in which the resistance per unit length along the moving direction of the movable electrodes 11, 12 is relatively small is smaller when the same current flows in the segment on the end R side of the workpiece W2 and the segment on the end L side for the same time.

Accordingly, by adjusting the electric current applied between the pair of electrodes 13 based on variations in resistance of the segments obtained from the shape or size of the workpiece W2, that is, variations in resistance per unit length of the workpiece W2 along the moving direction of the movable electrode 11, it is possible to substantially equalize the amount of heat generated in each segment and to heat the workpiece W2 to be in a predetermined temperature range that can be considered as a substantially uniform temperature.

Figure 7A:
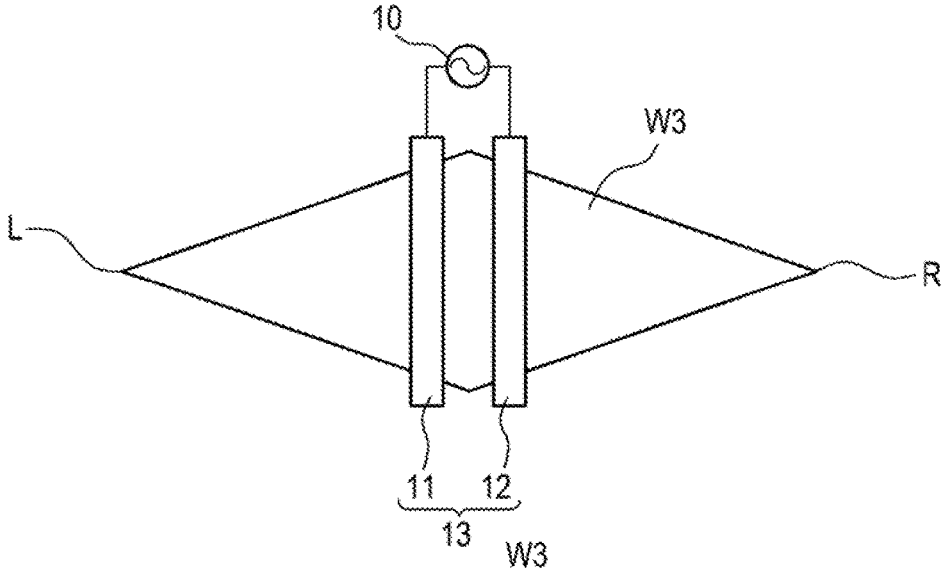
FIGS. 7A to 7D are diagrams illustrating another modified example of the workpiece, the heating apparatus, and the heating method illustrated in FIGS. 3A to 3D.
Figure 7B:
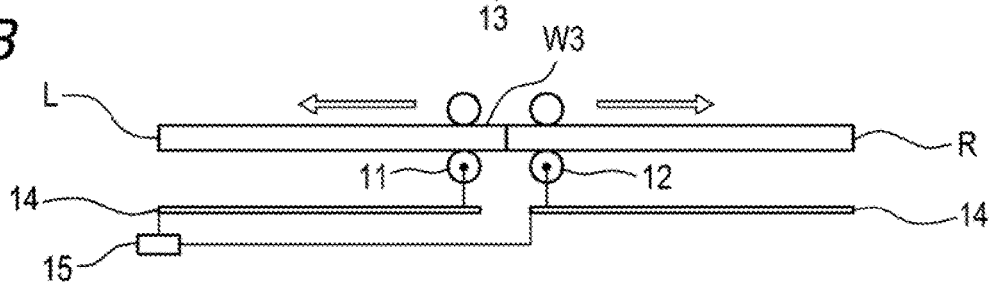
Figure 7C:
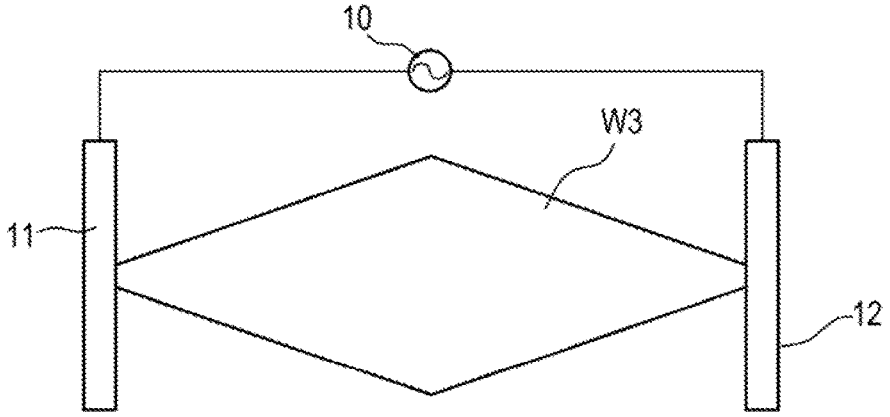
Figure 7D:
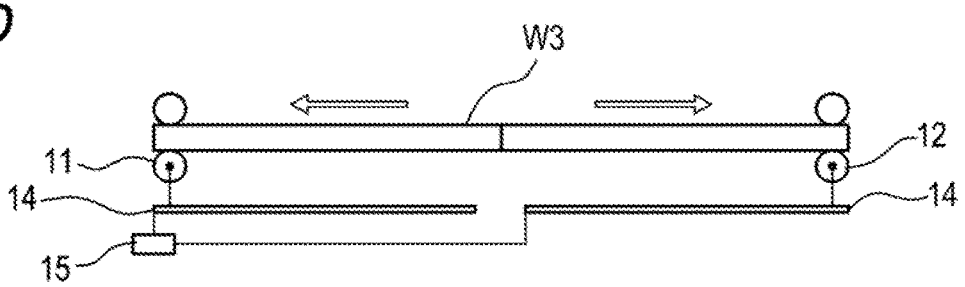

A workpiece W3 illustrated in FIGS. 7A to 71) has a constant thickness and a width which gradually decreases from the center in the longitudinal direction to one end L and the other end R, and is substantially symmetric with respect to the center. In the workpiece W3 having this shape, when the workpiece W3 is divided into a heating area on the end L side and a heating area on the end R side with the center in the longitudinal direction as a boundary, resistance per unit length along the longitudinal direction in each heating area monotonically increases from the center having a relatively large width to the end L or the end R having a relatively small width.

When the heating of the workpiece W3 in a predetermined temperature range is intended, one movable electrode 11 may be moved from the center of the workpiece W3 to the end L along the longitudinal direction of the workpiece W3 at a constant speed and the other movable electrode 12 may be moved from the center of the workpiece W3 to the end R along the longitudinal direction of the workpiece W3 at the same constant speed while applying electric current between the pair of electrodes 13.

The current applying section of the heating area on the end L side of the workpiece W3 is gradually expanded from the center of the workpiece W3 at which resistance per unit length along the moving direction of the movable electrode 11 moving in the heating area on the end L side is relatively small. The current applying section of the heating area on the end R side of the workpiece W3 is gradually expanded from the center of the workpiece W3 at which resistance per unit length along the moving direction of the movable electrode 12 moving in the heating area on the end L side is relatively small.

Accordingly, by adjusting the electric current applied between the pair of electrodes 13 based on variations in resistance of the segments obtained from the shape or size of the workpiece W3, that is, variations in resistance per unit length of the workpiece W3 along the moving direction of the movable electrodes 11, 12, it is possible to substantially equalize the amount of heat generated in each segment and to heat the workpiece W3 to be in a predetermined temperature range that can be considered as a substantially uniform temperature.

A workpiece W4 illustrated in FIGS. 8A to 8F has a constant thickness and a width which gradually increases from the center in the longitudinal direction to one end L and the other end R, and is substantially symmetric with respect to the center. In the workpiece W4 having this shape, when the workpiece W4 is divided into a heating area on the end L side and a heating area on the end R side with the center in the longitudinal direction as a boundary, resistance per unit length along the longitudinal direction in each heating area monotonically increases from the end L or the end R having a relatively large width to the center having a relatively small width.

When the heating of the workpiece W4 in a predetermined temperature range is intended, a pair of electrodes 13 and a moving mechanism 14 may be installed in each of the heating area on the end L side of the workpiece W4 and the heating area on the end R side, a movable electrode 11 may be moved from the end L to the center along the longitudinal direction of the workpiece W4 at a constant speed with a fixed electrode 12 disposed at the end L in the heating area on the end L side, and the movable electrode 11 may be moved from the end R to the center along the longitudinal direction of the workpiece W4 at a constant speed with the fixed electrode 12 disposed at the end R in the heating area on the end R side.

The current applying section of the heating area on the end L side of the workpiece W4 is gradually expanded from the end L at which resistance per unit length along the moving direction of the movable electrode 11 moving in the heating area on the end L side is relatively small. The current applying section of the heating area on the end R side of the workpiece W4 is gradually expanded from the end R at which resistance per unit length along the moving direction of the movable electrode 12 moving in the heating area on the end L side is relatively small.

Accordingly, by adjusting the electric current applied between the pair of electrodes 13 based on variations in resistance of the segments obtained from the shape or size of the workpiece W4, that is, variations in resistance per unit length of the workpiece W4 along the moving direction of the movable electrodes 11, 12, it is possible to substantially equalize the amount of heat generated in each segment and to heat the workpiece W4 to be in a predetermined temperature range that can be considered as a substantially uniform temperature.

Figure 8A:
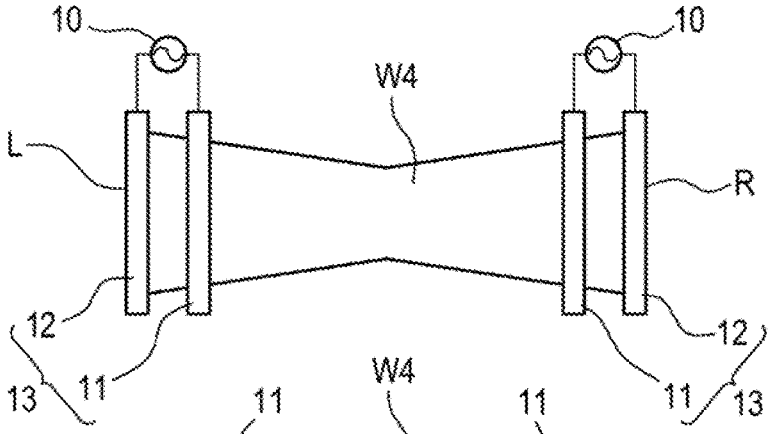
FIGS. 8A to 8F are diagrams illustrating still another modified example of the workpiece, the heating apparatus, and the heating method illustrated in FIGS. 3A to 3D.
Figure 8B:
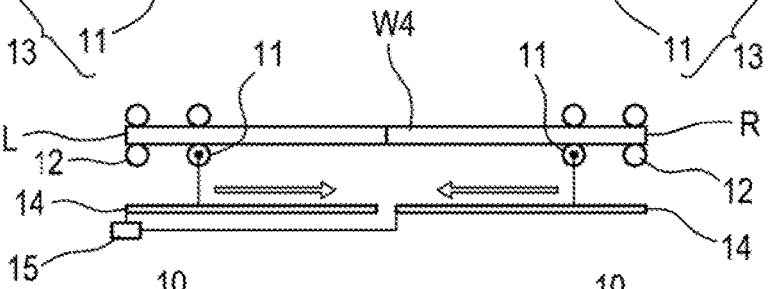
Figure 8C:
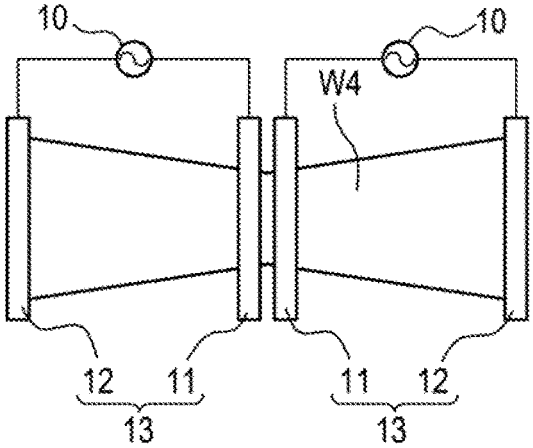
Figure 8D:
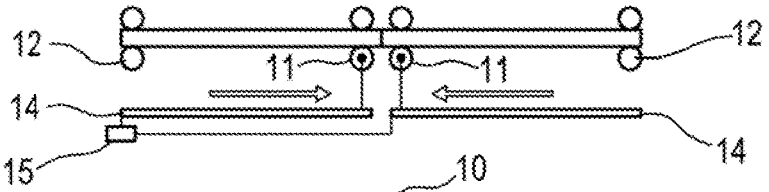
Figure 8E:
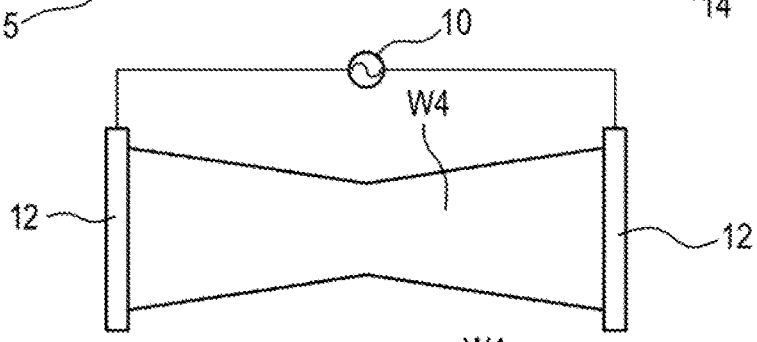
Figure 8F:
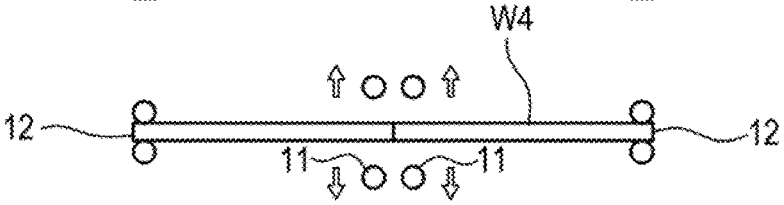
Figure 9A:
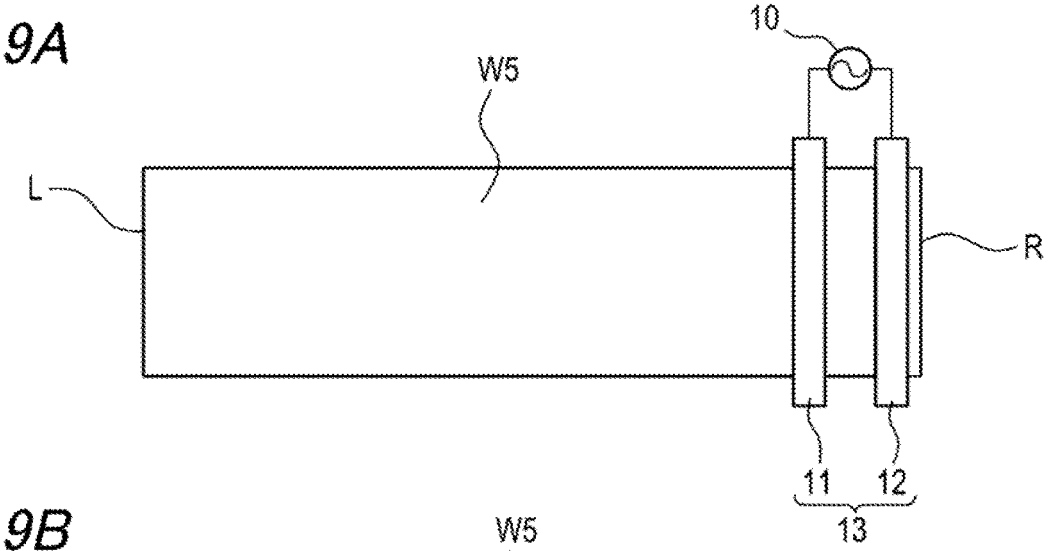
FIGS. 9A to 9D are diagrams illustrating still another modified example of the workpiece, the heating apparatus, and the heating method illustrated in FIGS. 3A to 3D.
Figure 9B:
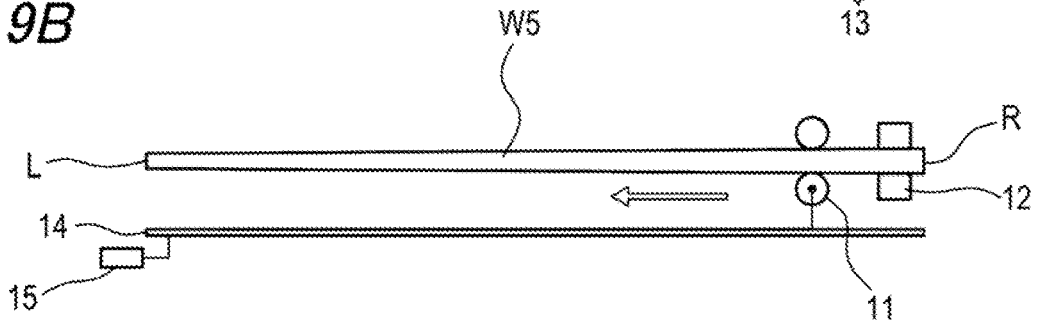
Figure 9C:
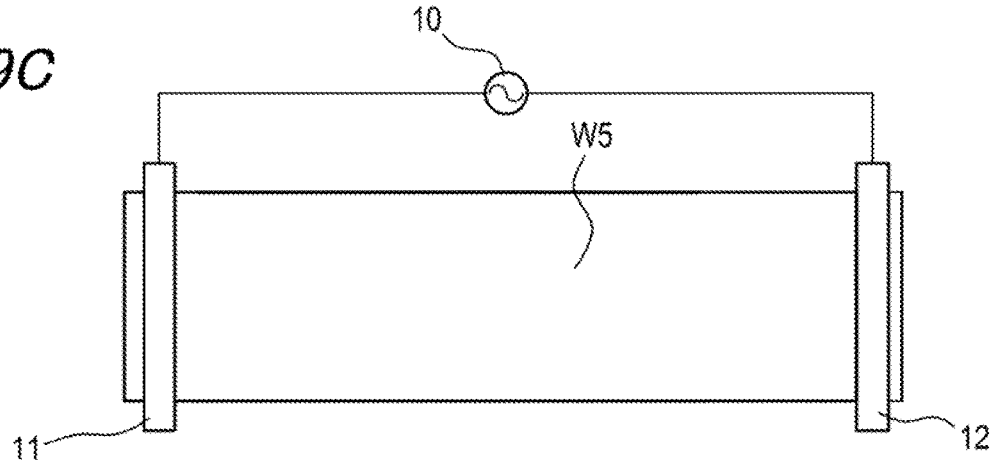
Figure 9D:
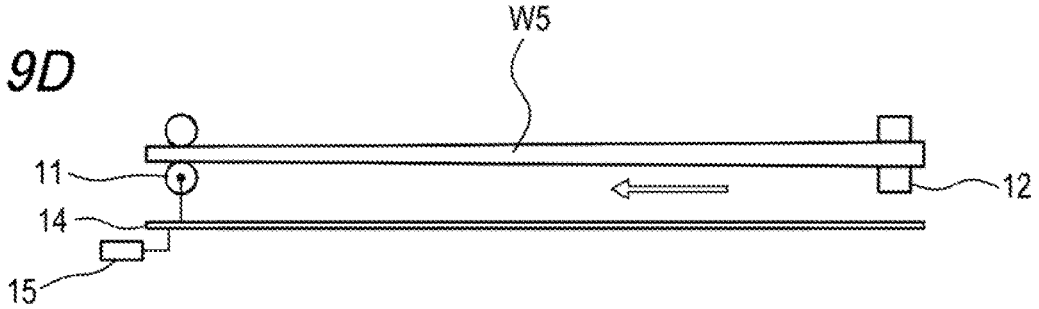

As illustrated in FIGS. 8E and 8F, the center of the workpiece W4 interposed between the movable electrodes 11 of the pairs of electrodes 13 may be heated by direct resistance heating by detaching the movable electrodes 11 from the workpiece W4 after the movable electrodes 11 of the pairs of electrodes 13 reach the center of the workpiece W4 and applying electric current between the fixed electrodes 12 of the pairs of electrodes.

While the thickness of a workpiece has been described as being constant and the variation in resistance per unit length along the longitudinal direction of the workpiece results from a variation in width, the variation in resistance may result from a variation in thickness or a variation in thickness and width.

A workpiece W5 illustrated in FIGS. 9A to 9D has a constant width and a thickness which gradually decreases from one end R in the longitudinal direction to the other end R. In the workpiece W5 having this shape, resistance per unit length along the longitudinal direction monotonically increases from the end R having a relatively large thickness to the end L having a relatively small thickness.

When the heating of the workpiece W5 in a predetermined temperature range is intended, a movable electrode 11 may be moved from the end R to the end L at a constant speed with a fixed electrode 12 disposed at the end R.

The current applying section in the workpiece W5 is gradually expanded from the end R at which resistance per unit length along the moving direction of the movable electrode 11 is relatively small.

Accordingly, by adjusting the electric current applied between the pair of electrodes 13 based on variations in resistance of segments obtained from the shape or size of the workpiece W5, that is, variations in resistance per unit length of the workpiece W5 along the moving direction of the movable electrode 11, it is possible to substantially equalize the amount of heat generated in each segment and to heat the workpiece W5 to be in a predetermined temperature range that can be considered as a substantially uniform temperature.

Figure 10:
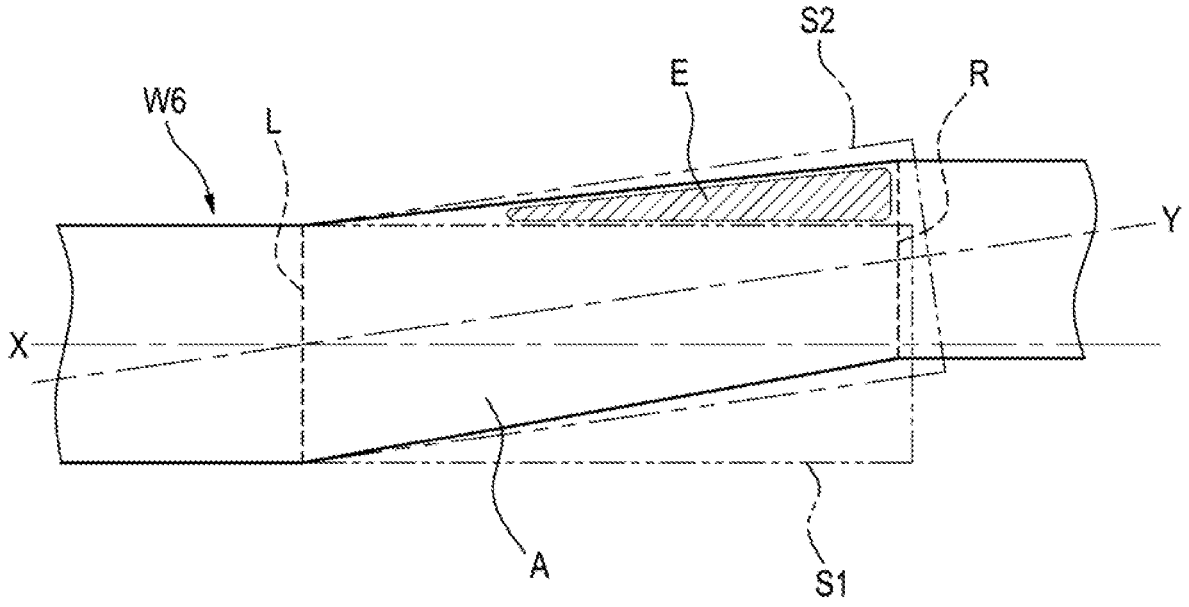
FIG. 10 is a diagram illustrating a configuration of another example of a plate workpiece according to an embodiment of the invention.
Figure 11A:
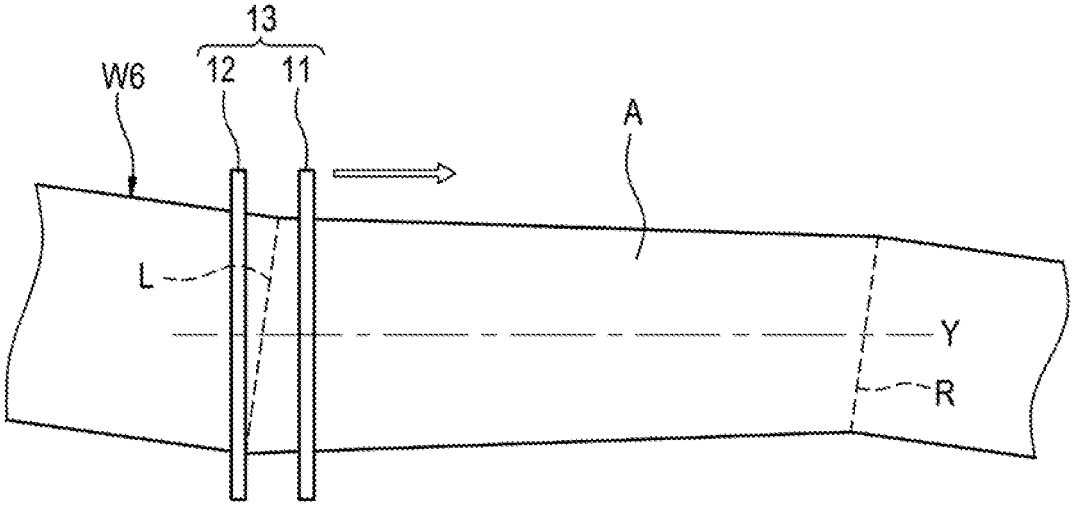
FIGS. 11A and 11B are diagrams illustrating a configuration of a heating apparatus for heating a workpiece illustrated in FIG. 10 and a heating method.
Figure 11B:
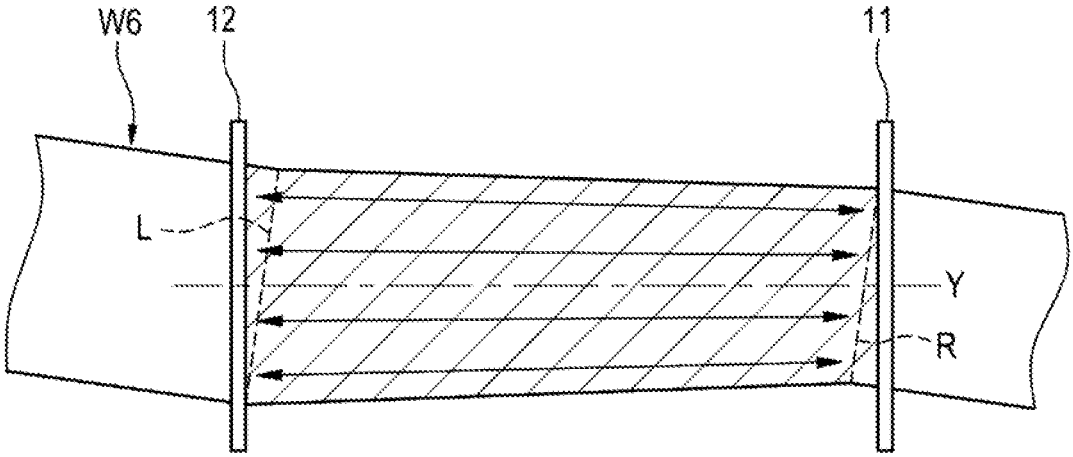

FIG. 10 illustrates a configuration of an example of a plate workpiece according to the embodiment of the invention. FIGS. 11A and 11B illustrate a configuration of a heating apparatus for heating the workpiece illustrated in FIG. 10 and a heating method thereof.

A part of a workpiece W6 illustrated in FIG. 10 serves as a heating area A. The heating area A has a constant thickness and a width which gradually decreases from one end L in the longitudinal direction to the other end R.

The heating area A is asymmetric with respect to an axis X passing through the center of one end L and extending along the longitudinal direction of the workpiece W6, and the other end R is deviated in the direction perpendicular to the axis X with respect to one end L. Accordingly, when a sweep area S1 formed by sweeping the end L having a relatively large width along the axis X is assumed, an area E departing from the sweep area S1 is present in the heating area A. On the other hand, when a sweep area S2 formed by sweeping the end L along a center line Y connecting the centers of both ends L and R is assumed, the entire heating area A is included in the sweep area S2.

A heating apparatus for heating the workpiece W6 has the same configuration as the heating apparatus 1 illustrated in FIGS. 1A to 1D and includes a current supply unit 10, a pair of electrodes 13 including electrodes 11, 12, and a moving mechanism and a control unit which are not illustrated.

In this example, the electrodes 11, 12 of the pair of electrodes 13 have a length extending across the heating area A in a direction perpendicular to the center line Y and are arranged on the workpiece W6 along the direction perpendicular to the center line Y. In the example illustrated in FIGS. 11A and 11B, the electrode 12 is disposed at the end L having a relatively large width in the workpiece W6 and is fixed at the position, and the electrode 11 is supported by the moving mechanism so as to be movable along the center line Y while maintaining contact with the workpiece W6. Hereinafter, the electrode 11 is referred to as a movable electrode and the electrode 12 is referred to as a fixed electrode.

The moving mechanism moves the movable electrode 11 at a constant speed along the center line Y under the control of the control unit.

When heating the workpiece W6, the movable electrode 11 is placed at the end L of the workpiece W6 at which the fixed electrode 12 is disposed. Then, the movable electrode 11 is moved at a constant speed from the end L of the workpiece W6 to the end R in a state in which electric current is applied between the pair of electrodes 13.

Figure 12A:
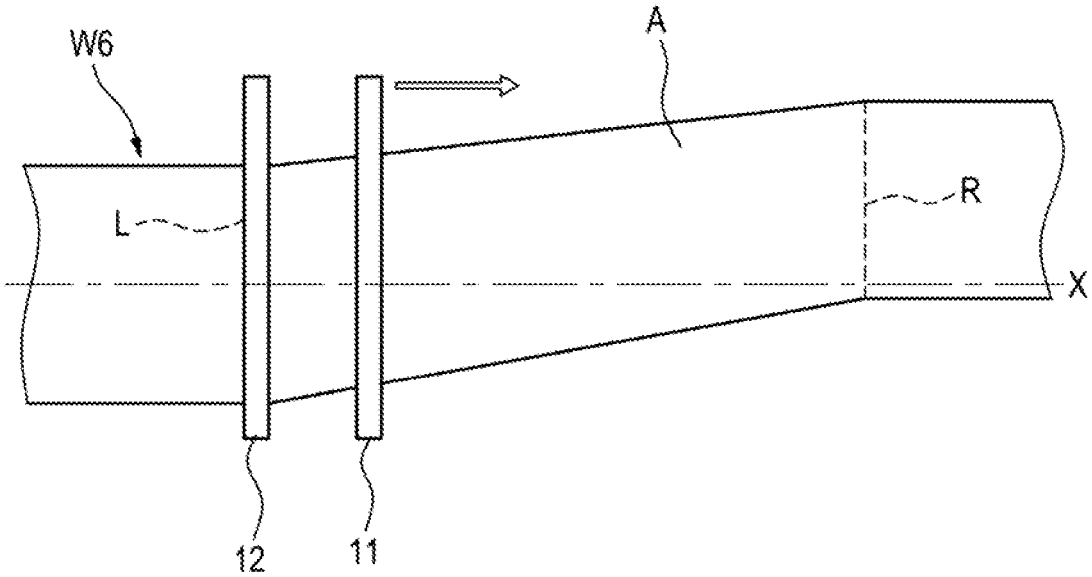
FIGS. 12A and 12B are diagrams illustrating a reference example of the heating method of the workpiece illustrated in FIG. 10.
Figure 12B:
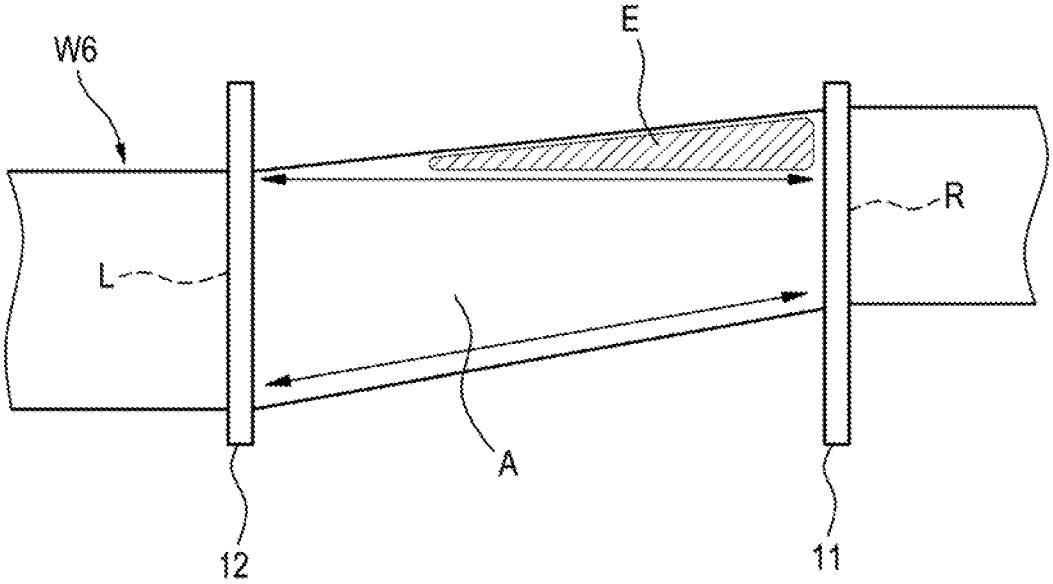
Figure 13A:
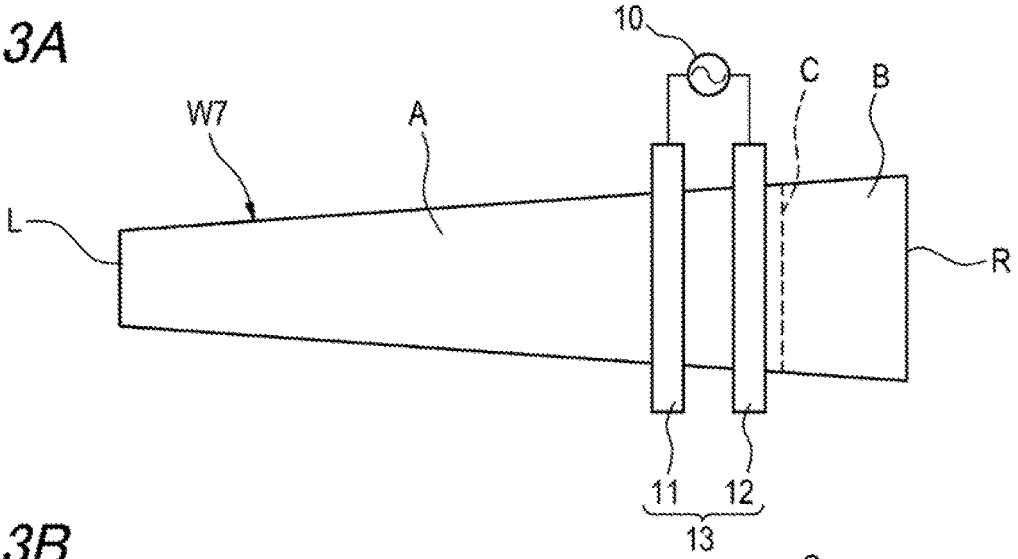
FIGS. 13A to 13D are diagrams illustrating a configuration of still another example of a plate workpiece and a heating apparatus and a heating method according to an embodiment of the invention.
Figure 13B:
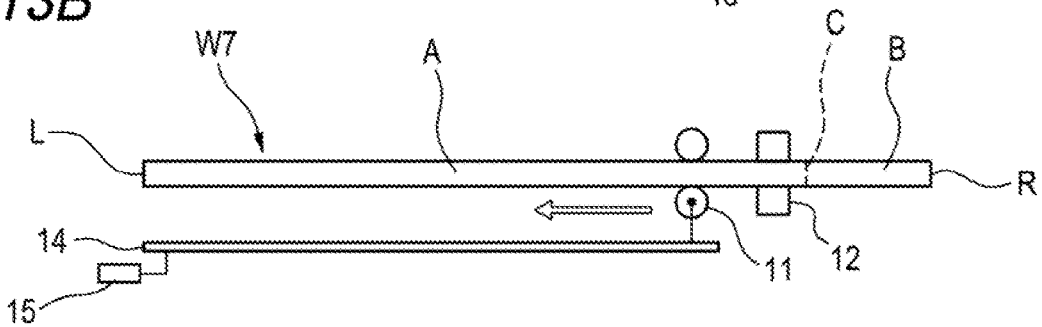
Figure 13C:
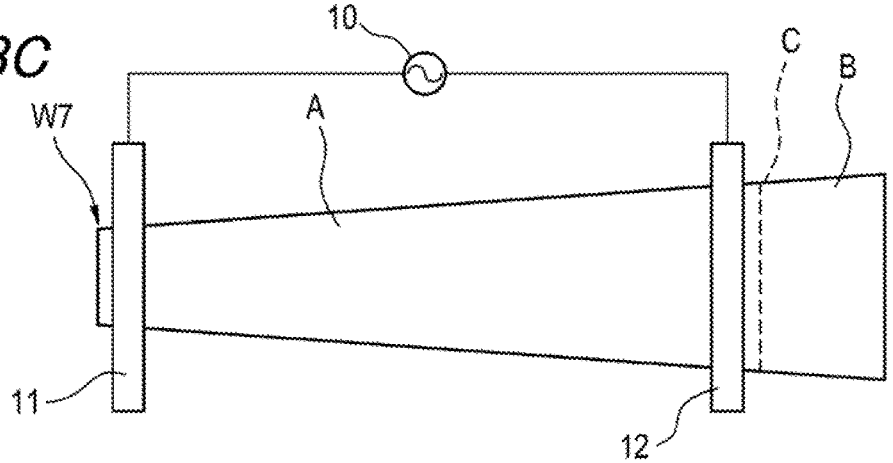
Figure 13D:
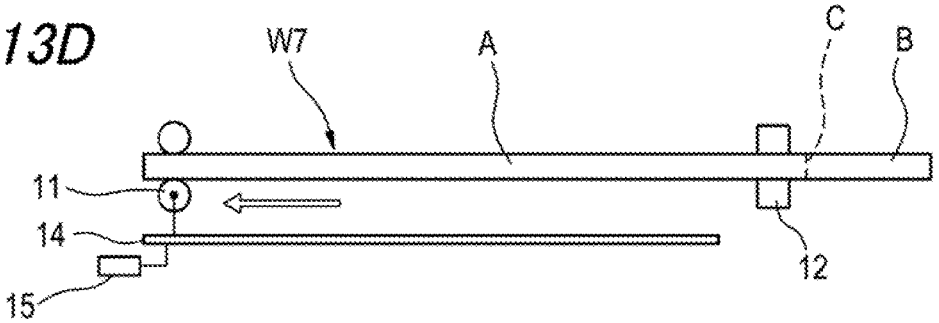

Here, the current flowing in the pair of electrodes 13 typically tends to flow along the shortest path in a current applying section of the workpiece W6 interposed between the movable electrode 11 and the fixed electrode 12. Accordingly, when the movable electrode 11 and the fixed electrode 12 are arranged in the direction perpendicular to the axis X as illustrated in FIGS. 12A and 12B, it is difficult for electric current to flow in the area E of the heating area A excluded from the sweep area S1.

In contrast, when the movable electrode 11 and the fixed electrode 12 are arranged along the direction perpendicular to the center line Y, the whole heating area A is included in the sweep area S2 and thus electric current flows substantially uniformly in the current applying section of the workpiece W6. Accordingly, it is possible to heat the workpiece W6 in a predetermined temperature distribution.

In an example to be described below, a first heating area and a second heating area are formed in a plate workpiece, and the first heating area and the second heating area are heated to be in different temperature ranges.

FIGS. 13A to 13D illustrate a configuration of another example of the plate workpiece and the heating apparatus according to the embodiment of the invention and a heating method thereof.

A workpiece W7 illustrated in FIGS. 13A to 13D has a constant thickness and a width which gradually decreases from one end R in the longitudinal direction to the other end L. The workpiece W7 includes a first heating area A formed on the end L side having a relatively small width and a second heating area B formed on the end R side having a relatively large width, and the second heating area B is adjacent to the first heating area A in the longitudinal direction and is formed integrally with the first heating area A. Materials of the first heating area A and the second heating area B are different from each other and both are welded to each other to form a unified body.

In this example, only the first heating area A is heated and the second heating area B is not heated. The workpiece W7 is used, for example, as an impact absorbing member, the first heating area A increases in hardness by heating, and the second heating area B is not heated and is thus kept soft so as to be easily deformed by impact or the like.

A heating apparatus for heating the workpiece W7 has the same configuration as the heating apparatus 1 illustrated in FIGS. 1A to 1D and includes a current supply unit 10, a pair of electrodes 13 including electrodes 11, 12, a moving mechanism 14, and a control unit 15.

The electrodes 11, 12 of the pair of electrodes 13 are arranged along the width direction of the workpiece W7, each of the electrodes 11, 12 having a length extending across the heating area A of the workpiece W7 in the width direction. In the example illustrated in FIGS. 13A to 13D, the electrode 12 is disposed at an end having a relatively large width in the first heating area A, that is, an end on a joint C side between the first heating area A and the second heating area B and is fixed at the position. The electrode 11 is supported by the moving mechanism 14 so as to be movable along the longitudinal direction of the workpiece W7 in the first heating area A while maintaining contact with the workpiece W7. Hereinafter, the electrode 11 is referred to as a movable electrode and the electrode 12 is referred to as a fixed electrode.

The moving mechanism 14 moves the movable electrode 11 at a constant speed along the longitudinal direction of the workpiece W7 under the control of the control unit 15.

When heating the workpiece W7, in the example illustrated in FIGS. 13A to 13D, the movable electrode 11 is placed at the end on the joint C side of the first heating area A at which the fixed electrode 12 is disposed. Then, the movable electrode 11 is moved at a constant speed to the end L opposite to the joint C side of the first heating area A in a state in which electric current is applied between the pair of electrodes 13.

While moving the movable electrode 11 at a constant speed, the electric current applied between the pair of electrodes 13 is adjusted such that the heating temperature is adjusted for each segment into which the first heating area A is virtually divided so as to be side by side in the moving direction of the movable electrode 11.

Particularly, in the heating area A in which the resistance per unit length along the moving direction of the movable electrode 11 monotonically increases in the moving direction of the movable electrode 11, it is possible to heat the first heating area A in a predetermined temperature range that can be considered as a substantially uniform temperature in the same way as in the heating method illustrated in FIGS. 3A to 3D.

Figure 14A:
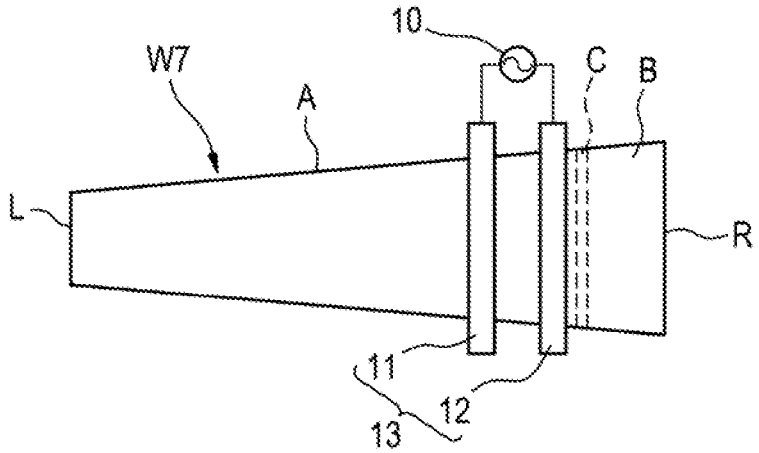
FIGS. 14A to 14G are diagrams illustrating a modified example of the plate workpiece and the heating apparatus and the heating method illustrated in FIGS. 13A to 13D.
Figure 14B:
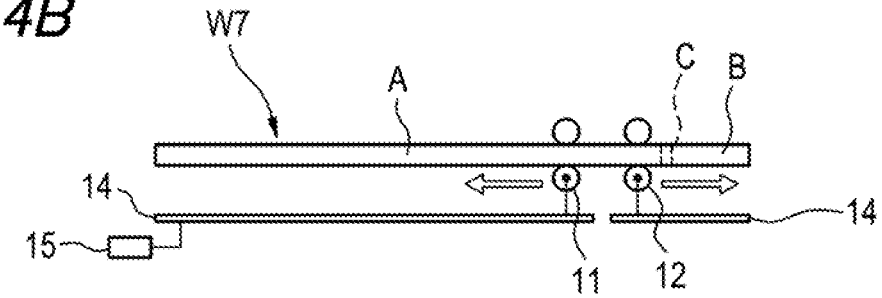
Figure 14C:
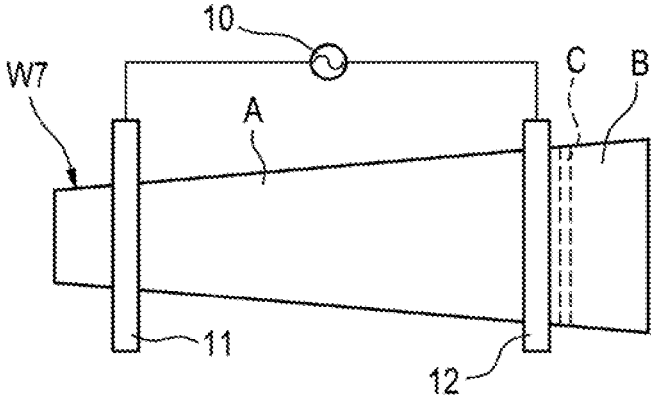
Figure 14D:
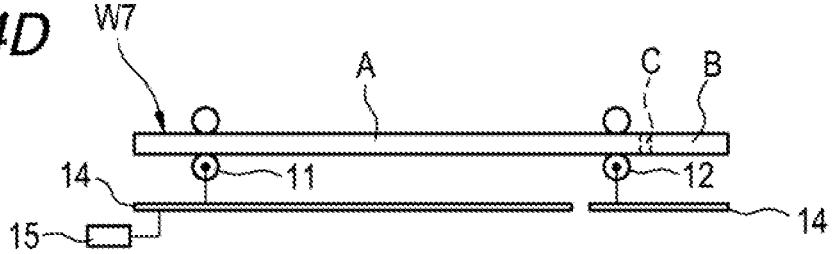
Figure 14E:
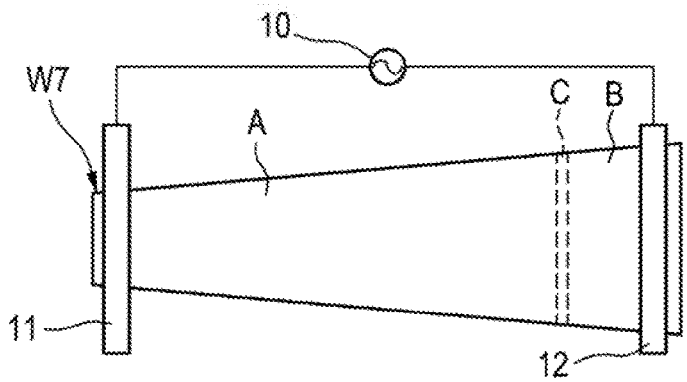
Figure 14F:
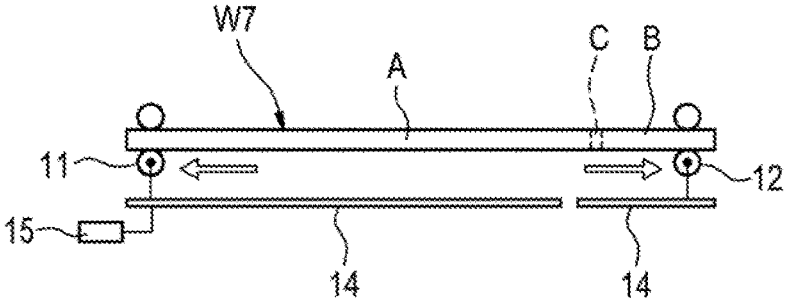
Figure 14G:
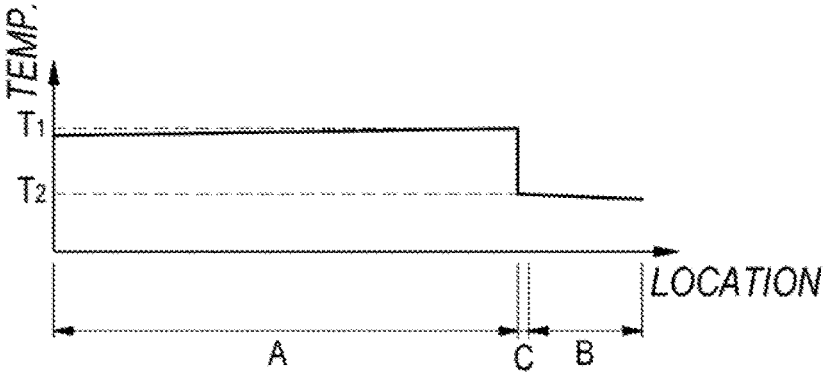
Figure 15A:
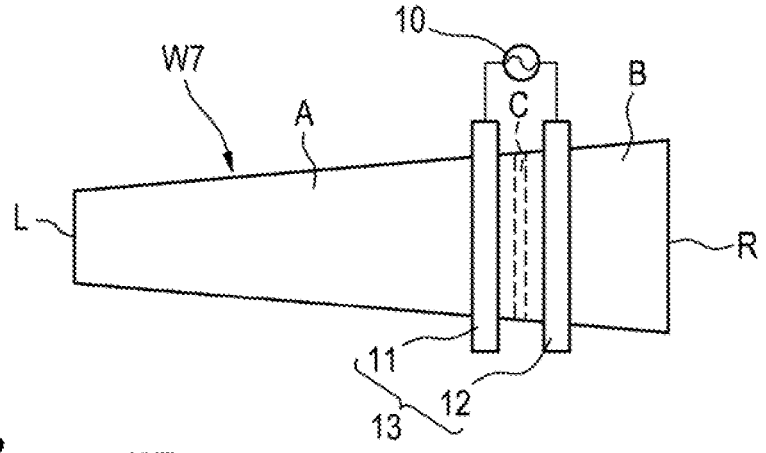
FIGS. 15A to 15G are diagrams illustrating another modified example of the plate workpiece and the heating apparatus and the heating method illustrated in FIGS. 13A to 13D.
Figure 15B:
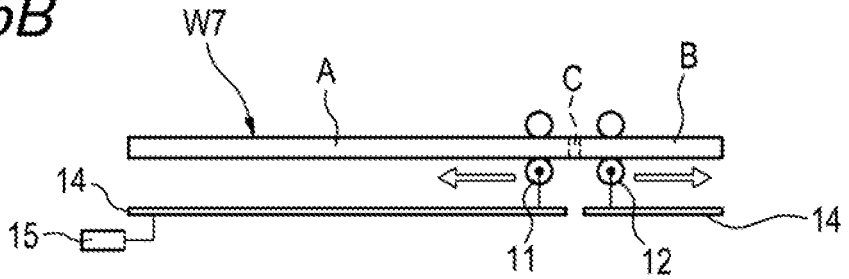
Figure 15C:
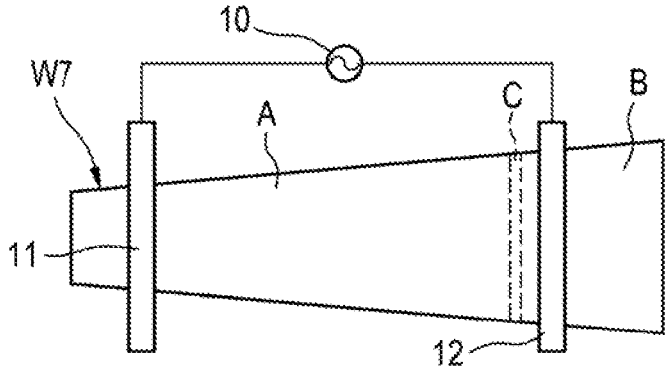
Figure 15D:
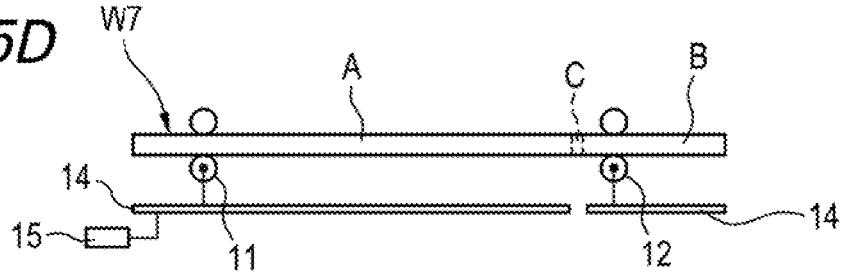
Figure 15E:
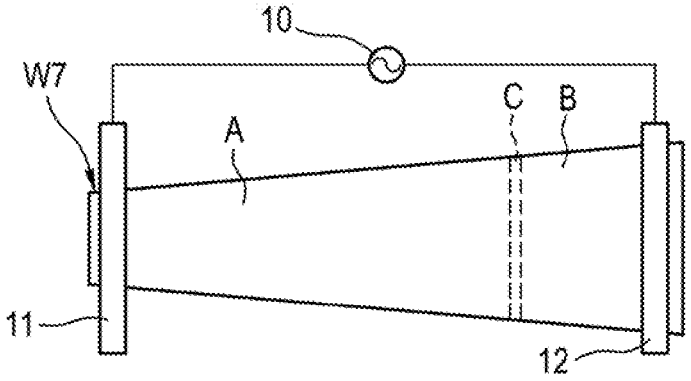
Figure 15F:
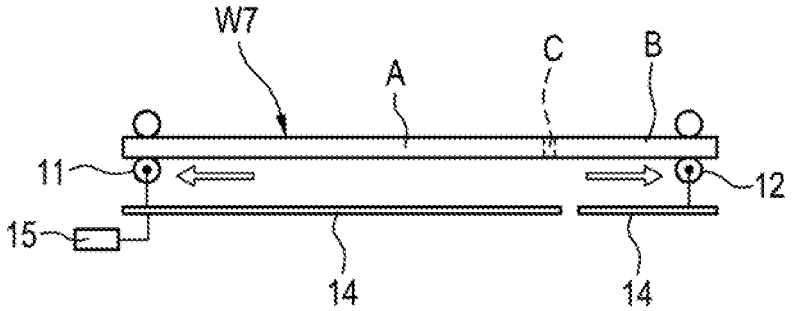
Figure 15G:
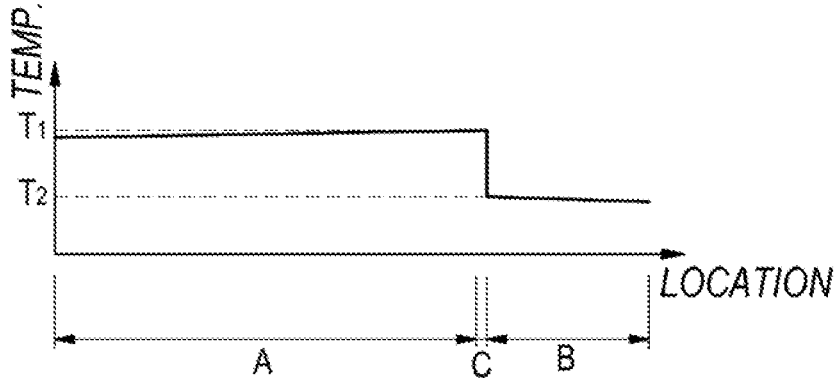

FIGS. 14A to 161 illustrate modified examples of the plate workpiece, the heating apparatus, and the heating method illustrated in FIGS. 13A to 13D.

In the example illustrated in FIGS. 14A to 14, the first heating area A of the workpiece W7 is heated at a hot working temperature T1, and the second heating area B is heated at a warm working temperature T2 which is lower than the heating temperature T1 of the first heating area A.

When the second heating area B is heated, a moving mechanism 14 may also be installed in the electrode 12, the electrode 12 may be supported so as to be movable along the longitudinal direction of the workpiece W7 in the second heating area B while maintaining contact with the workpiece W7, and the movable electrode 12 may be moved at a constant speed from the end on the joint C side of the second heating area B to the end R. At this time, the movable electrode 12 is moved such that the movable electrode 12 moving in the second heating area B reaches the end R before the movable electrode 11 moving in the first heating area A reaches the end L. Movement start times and movement end times of the movable electrodes 11, 12 can be appropriately set depending on the size in the left-right direction of the first heating area A and the second heating area B or the heating temperatures of the heating areas.

In the example illustrated in FIGS. 14A to 14G, both the movable electrodes 11, 12 are disposed in the first heating area A at the time of heating start, and the joint C is heated to the warm working temperature T2 which is the same as in the second heating area B. On the other hand, as illustrated in FIGS. 15A to 15G, at the time of heating start, the movable electrode 11 is disposed in the first heating area A, the movable electrode 12 is disposed in the second heating area, and the joint C is heated to the hot working temperature T1 which is the same as in the first heating area A.

Figure 16A:
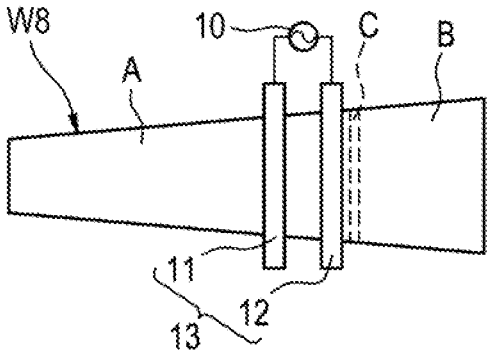
Figure 16B:
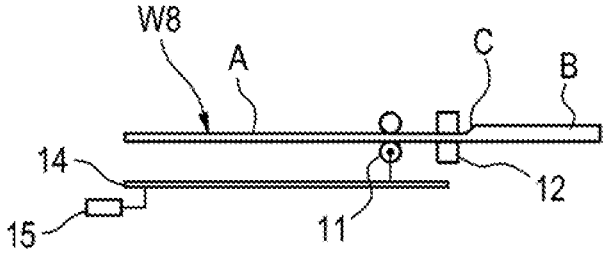
Figure 16C:
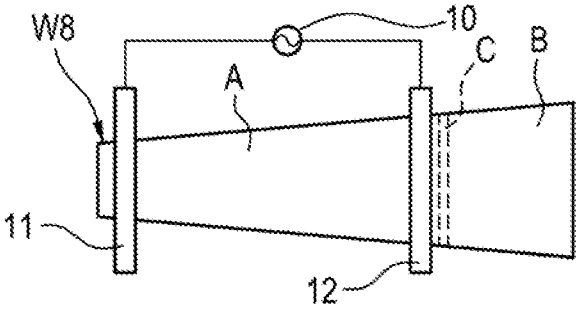
Figure 16D:
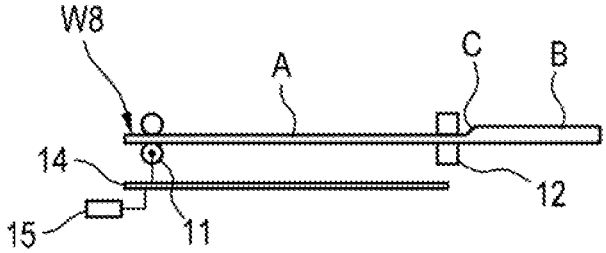
Figure 16E:
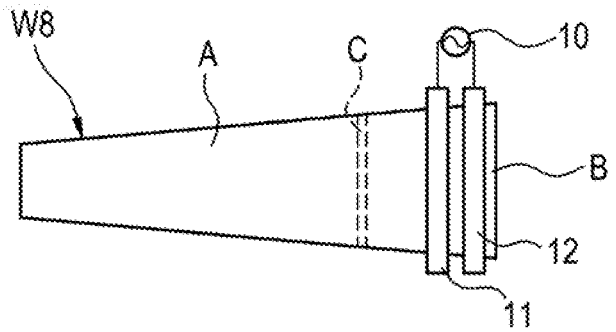
Figure 16F:
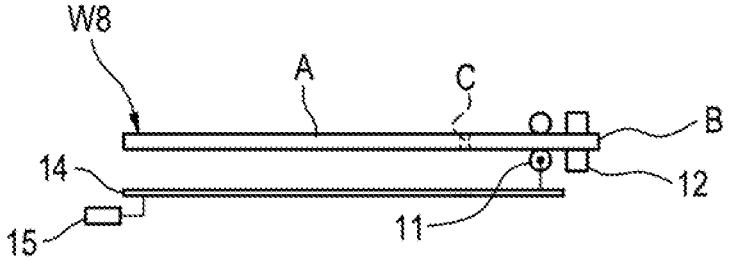
Figure 16G:
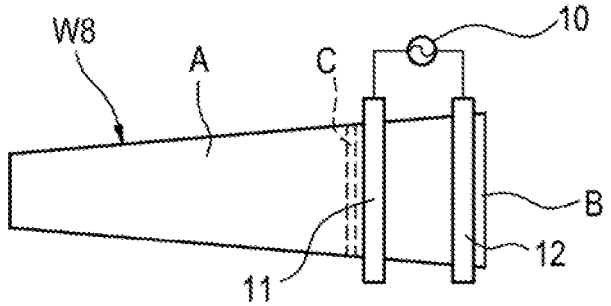
Figure 16H:
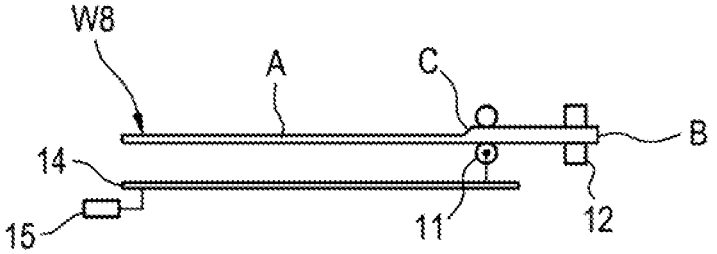
Figure 16I:
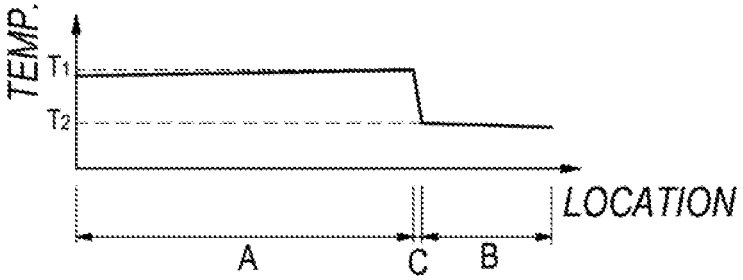

A workpiece W8 illustrated in FIGS. 16A to 161-1 is different from the workpiece W7 illustrated in FIGS. 14A to 14F, in that the thickness of the first heating area A and the thickness of the second heating area B are different from each other. An inclination is formed in the joint C between the first heating area A and the second heating area B due to the difference in thickness between both heating areas A and B, and unevenness may be formed due to welding. In this case, it is preferable that electric current is not directly applied to the joint C. This is because a spark may occur when the electrodes slide on the joint C.

When heating the workpiece W8, the first heating area A is first heated and the movable electrode 11 and the fixed electrode 12 are placed at the end on the joint C side of the first heating area A. Then, the movable electrode 11 is moved at a constant speed to the end L opposite to the joint C side of the first heating area A in a state in which electric current is applied between the pair of electrodes 13.

While moving the movable electrode 11 at a constant speed, the electric current applied between the pair of electrodes 13 is adjusted such that the heating temperature is adjusted for each segment into which the first heating area A is virtually divided so as to be side by side in the moving direction of the movable electrode 11.

Subsequently, the second heating area B is heated and the movable electrode 11 and the fixed electrode 12 are placed at the end R opposite to the joint C side of the second heating area B. Then, the movable electrode 11 is moved at a constant speed to the end on the joint C side of the second heating area B in a state in which electric current is applied between the pair of electrodes 13.

While moving the movable electrode 11 at a constant speed, the electric current applied between the pair of electrodes 13 is adjusted such that the heating temperature is adjusted for each segment into which the second heating area B is virtually divided so as to be side by side in the moving direction of the movable electrode 11.

Particularly, in each of the first heating area A and the second heating area B, resistance per unit length along the moving direction of the movable electrode 11 monotonically increases in the moving direction of the movable electrode 11. Accordingly, it is possible to heat the first heating area A and the second heating area B in a predetermined temperature range that can be considered as a substantially uniform temperature in the same way as in the heating method illustrated in FIGS. 3A to 3D.

The joint C is heated by heat transmitted from both the first heating area A and the second heating area B.

The heating method described above may be used, for example, in a quenching process using rapid cooling after heating or may be used in a press-molded article manufacturing method of pressing a workpiece with a press mold in a high-temperature state after heating to perform a hot press molding process. According to the above-mentioned heating method, equipment for heating may have a simple configuration, or the equipment for heating may be disposed close to a press machine or may be assembled into the press machine. Accordingly, since a plate workpiece can be subjected to press molding in a short time after the plate workpiece is heated, it is possible to suppress a temperature fall of the heated plate workpiece to reduce energy loss and it is also possible to prevent oxidation of the surface of the plate workpiece, thereby manufacturing a press-molded article with high quality.

The invention claimed is:

1. A heating method comprising:

arranging a pair of electrodes on a workpiece along a first direction, the pair of electrodes having a length extending across a first heating area of the workpiece in the first direction;

moving at least one of the electrodes relative to and in contact with the workpiece in the first heating area and along a second direction intersecting the first direction at a constant speed while applying electric current between the pair of electrodes to heat the first heating area by direct resistance heating; and adjusting the electric current applied between the pair of electrodes during the moving of the at least one of the electrodes relative to and in contact with the workpiece such that a heating temperature is adjusted for each segment into which the first heating area is divided so as to be side by side in the second direction, wherein:

resistance of the workpiece per unit length along the second direction in the first heating area varies along the second direction;

the electric current applied between the pair of electrodes is adjusted based on the variation in the resistance;

the resistance in the first heating area monotonically increases along the second direction;

one of the electrodes is moved in the second direction such that a current applying section in the first heating area is gradually expanded from an end of the first heating area at which the resistance is relatively smaller than another part of the first heating area; and the electric current applied between the pair of electrodes is adjusted such that the first heating area is heated to be in a predetermined temperature range by the direct resistance heating.

2. The heating method according to claim 1, wherein the second direction is a direction along a center line that connects centers of both end portions of the first heating area in the second direction to each other, and wherein the first direction is a direction perpendicular to the center line.

3. The heating method according to claim 1, wherein the workpiece has a second heating area provided adjacent to the first heating area in the second direction and integrally formed with the first heating area, and the second heating area being welded to the first heating area, wherein a first of the electrodes is moved in the first heating area and along the second direction and a second of the electrodes is placed at a joint between the first heating area and the second heating area to heat the first heating area by the direct resistance heating, and wherein the first heating area and the second heating area are heated to be in different temperature ranges.

4. A heating apparatus comprising:

a pair of electrodes arranged to extend across a first heating area of a workpiece in a first direction;

a current supply unit coupled to the pair of electrodes and configured to supply electric current to the pair of electrodes;

a moving mechanism coupled to the pair of electrodes and configured to move at least one of the electrodes relative to and in contact with the workpiece in the first heating area and along a second direction intersecting the first direction; and a control unit coupled to the moving mechanism to move the at least one of the electrodes relative to the workpiece at a constant speed and configured to adjust the electric current applied between the pair of electrodes during movement of the at least one of the electrodes relative to and in contact with the workpiece such that a heating temperature is adjusted for each segment into which the first heating area is divided so as to be side by side in the second direction, wherein the control unit is further configured to:

vary resistance of the workpiece per unit length along the second direction in the first heating area along the second direction;

adjust the electric current applied between the pair of electrodes based on the variation in the resistance;

monotonically increase the resistance in the first heating area along the second direction;

move one of the electrodes in the second direction such that a current applying section in the first heating area is gradually expanded from an end of the first heating area at which the resistance is relatively smaller than another part of the first heating area; and adjust the electric current applied between the pair of electrodes such that the first heating area is heated to be in a predetermined temperature range by the direct resistance heating.

5. A method of manufacturing a press-molded article, the method comprising:

arranging a pair of electrodes on a workpiece along a first direction, the pair electrodes having a length extending across a first heating area of the workpiece in the first direction;

moving at least one of the electrodes relative to and in contact with the workpiece in the first heating area and along a second direction intersecting the first direction at a constant speed while applying electric current between the pair of electrodes to heat the first heating area by direct resistance heating;

adjusting the electric current applied between the pair of electrodes during the moving of the at least one of the electrodes relative to and in contact with the workpiece such that a heating temperature is adjusted for each segment into which the first heating area is divided so as to be side by side in the second direction; and performing a hot press molding process by pressing the workpiece using a press mold, wherein:

resistance of the workpiece per unit length along the second direction in the first heating area varies along the second direction;

the electric current applied between the pair of electrodes is adjusted based on the variation in the resistance;

the resistance in the first heating area monotonically increases along the second direction;

one of the electrodes is moved in the second direction such that a current applying section in the first heating area is gradually expanded from an end of the first heating area at which the resistance is relatively smaller than another part of the first heating area; and the electric current applied between the pair of electrodes is adjusted such that the first heating area is heated to be in a predetermined temperature range by the direct resistance heating.

* * * * *